US009574782B2

(12) United States Patent
Ohs

(10) Patent No.: US 9,574,782 B2
(45) Date of Patent: Feb. 21, 2017

(54) DEHUMIDIFICATION SYSTEM

(75) Inventor: Douglas G. Ohs, Oakdale, MN (US)

(73) Assignee: Innovent Air Handling Equipment, LLC, Minneapolis, MN (US)

( * ) Notice: Subject to any disclaimer, the term of this patent is extended or adjusted under 35 U.S.C. 154(b) by 0 days.

(21) Appl. No.: 13/355,007

(22) Filed: Jan. 20, 2012

(65) Prior Publication Data

US 2013/0186118 A1 Jul. 25, 2013

(51) Int. Cl.
*F25D 17/06* (2006.01)
*F24F 3/153* (2006.01)

(52) U.S. Cl.
CPC ..... *F24F 3/153* (2013.01); *F24F 2203/1032* (2013.01)

(58) Field of Classification Search
CPC ..... F24F 3/1423; F24F 2003/144; F24F 2003/1464; F24F 2203/1032
USPC ..... 62/91, 92, 271, 171
See application file for complete search history.

(56) References Cited

U.S. PATENT DOCUMENTS 3,009,684 A * 11/1961 Munters ..... 165/7
4,540,118 A * 9/1985 Lortie ..... F24F 3/0442 165/226
4,719,761 A 1/1988 Cromer
4,761,966 A * 8/1988 Stark ..... F24F 3/1405 236/44 C
4,926,618 A * 5/1990 Ratliff ..... B01D 53/06 95/10
5,251,458 A * 10/1993 Tchernev ..... 62/271
5,279,609 A * 1/1994 Meckler ..... 236/49.3
5,299,633 A * 4/1994 Bruggemann et al. ..... 165/113
5,353,606 A * 10/1994 Yoho et al. ..... 62/271
5,400,607 A * 3/1995 Cayce ..... F24F 3/1405 62/173
5,423,934 A 6/1995 Vangbo et al.
5,435,958 A 7/1995 Dinnage et al.
5,448,895 A * 9/1995 Coellner ..... F24F 3/1411 62/271
5,500,402 A 3/1996 Vangbo
5,502,975 A 4/1996 Brickley et al.
5,564,281 A * 10/1996 Calton et al. ..... 62/90
5,653,115 A 8/1997 Brickley et al.
5,816,065 A 10/1998 Maeda
5,839,288 A 11/1998 Dotson
5,894,751 A * 4/1999 Bourgoine et al. ..... 72/38
(Continued)

*Primary Examiner* — Len Tran
*Assistant Examiner* — Kirstin Oswald
(74) *Attorney, Agent, or Firm* — Merchant & Gould P.C.

(57) ABSTRACT

A dehumidification system is disclosed including a regeneration air flow path, a process air flow path, and a recirculation air flow path. In one embodiment, the regeneration air flow path includes a regeneration fan and a refrigeration system having an evaporator coil upstream of a condenser coil. The system also includes a desiccant wheel partially disposed within the process air flow path and partially disposed in the regeneration air flow path downstream of the refrigeration system. The recirculation air flow path is in fluid communication with the regeneration air flow path downstream of the regeneration fan at an inlet and upstream of the refrigeration system at an outlet. The recirculation air flow path is arranged to allow for an air flow to be recirculated through the refrigeration system and the desiccant wheel by the regeneration fan. A heat exchanger may also be provided in the regeneration air flow path.

18 Claims, 18 Drawing Sheets

(56) References Cited

U.S. PATENT DOCUMENTS 5,931,016 A 8/1999 Yoho, Sr.
5,937,667 A 8/1999 Yoho, Sr.
6,085,834 A 7/2000 Thomas et al.
6,170,271 B1 1/2001 Sullivan
6,196,014 B1 * 3/2001 Maeda ..... F24F 3/1423 55/351
6,199,394 B1 * 3/2001 Maeda ..... 62/271
6,237,354 B1 5/2001 Cromer
6,375,914 B1 4/2002 Vangbo
6,557,365 B2 5/2003 Dinnage et al.
6,711,907 B2 3/2004 Dinnage et al.
6,792,767 B1 * 9/2004 Pargeter ..... F24F 3/153 236/44 C
6,875,299 B1 4/2005 Vangbo
6,973,795 B1 12/2005 Moffitt
7,017,356 B2 3/2006 Moffitt
7,028,492 B2 * 4/2006 Taras ..... B60H 1/3207 62/159
7,047,751 B2 5/2006 Dinnage et al.
7,178,355 B2 2/2007 Moffitt
7,338,548 B2 * 3/2008 Boutall ..... 95/14
7,340,906 B2 3/2008 Moffitt
7,389,646 B2 6/2008 Moffitt
7,428,821 B2 * 9/2008 Kashirajima ..... F24F 3/1423 62/271
7,685,834 B2 3/2010 Moffitt
2003/0121271 A1 7/2003 Dinnage et al.
2003/0136140 A1 * 7/2003 Maeda ..... F24F 3/1405 62/271
2004/0000152 A1 * 1/2004 Fischer ..... F24F 3/1423 62/94
2004/0060315 A1 4/2004 Dinnage et al.
2004/0231179 A1 * 11/2004 Kodama ..... B01D 53/06 34/79
2005/0050906 A1 3/2005 Dinnage et al.
2006/0117780 A1 * 6/2006 Chin ..... F24F 3/1411 62/271
2006/0218949 A1 * 10/2006 Ellis ..... F24F 3/153 62/173
2007/0163279 A1 * 7/2007 Moffitt ..... F24F 3/1423 62/271

* cited by examiner

DEHUMIDIFICATION SYSTEM

BACKGROUND

Dehumidification systems are required for spaces and facilities in which humidity levels must be controlled to an acceptable level. Often systems are configured to utilize a refrigeration system in which an evaporator coil is used to remove moisture from the air and a downstream condensing coil is used to reheat the dehumidified air, which can then be delivered to a space. In some applications, these types of systems are utilized in conjunction with a desiccant wheel to aid in regenerating the wheel. However, the air used for the regeneration process is often ambient air which is subsequently exhausted from the system. One known system is disclosed in U.S. patent application Ser. No. 12/870,195 filed on Aug. 27, 2010 entitled High Efficiency Desiccant Dehumidifier, the entirety of which is incorporated by reference herein. Although satisfactory dehumidification performance can be achieved in systems incorporating a refrigeration system and a desiccant wheel, operating costs can be relatively. This is especially true for systems requiring supplemental heating of outdoor air to achieve satisfactory regeneration temperatures. Improvements are desired.

SUMMARY

A dehumidification system is disclosed. In one embodiment, the dehumidification system comprises a regeneration air flow path comprising a regeneration air fan and a refrigeration system having an evaporator coil upstream of a condenser coil. The dehumidification system may also include a process air flow path comprising a process air fan and a desiccant wheel partially disposed within the process air flow. The desiccant wheel is also partially disposed in the regeneration air flow path downstream of the refrigeration system. Furthermore, the system may include a recirculation air flow path in fluid communication with the regeneration air flow path downstream of the regeneration air fan and upstream of the refrigeration system wherein the recirculation air flow path is arranged to allow for an air flow to be recirculated through the refrigeration system and the desiccant wheel by the regeneration air fan. The system may also include a heat exchanger in the regeneration air flow path.

A method for dehumidifying air in a process air flow path is also disclosed. The method includes providing an air flow stream to a refrigeration system in a regeneration air flow path and cooling and dehumidifying the air flow stream with an evaporator coil of the refrigeration system. The method also includes heating the air flow stream with a condenser coil of the refrigeration system that is downstream of the evaporator coil. Another step is cooling and humidifying the air with a desiccant wheel that is downstream of the refrigeration system, the desiccant wheel also being in fluid communication with the process air flow path. Another step is recirculating the air back to the refrigeration system via a recirculation air flow path in fluid communication with the regeneration air flow path downstream of the desiccant wheel and upstream of the refrigeration system. The aforementioned steps may be repeated to result in a continuous process. The method may also include the step of mixing the recirculated air from the recirculation air flow path with ambient air upstream of the refrigeration system. The method may also include the step of heating the process air flow path with a second condenser coil of the refrigeration system. The method may also include the steps of heating and cooling the regeneration air with a heat exchanger.

DESCRIPTION OF THE DRAWINGS

Non-limiting and non-exhaustive embodiments are described with reference to the following figures, which are not necessarily drawn to scale, wherein like reference numerals refer to like parts throughout the various views unless otherwise specified.

DETAILED DESCRIPTION

Figure 1:
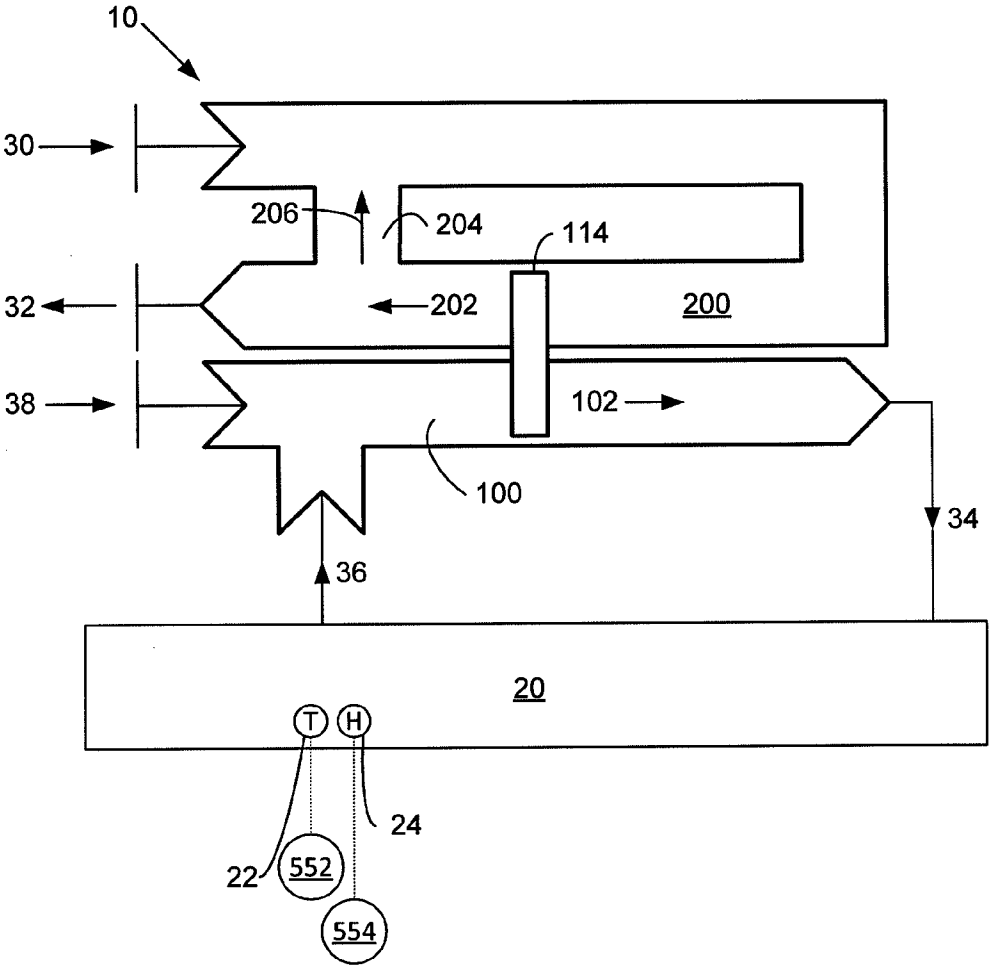
FIG. 1 is a schematic view of a dehumidification system having features that are examples of aspects in accordance with the principles of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

As used herein, the term "ambient air" refers to untreated air that is present in the outdoor environment or atmosphere. As used herein, the term "ambient air" may be used interchangeably with the terms "outside air" and "outdoor air."

Referring now to FIG. 1, an example dehumidification system 10 is shown. Dehumidification system 10 is for removing moisture from a space 20. Examples of spaces 20 that may require dehumidification are ice rinks, grocery stores, and cold storage rooms. One skilled in the art will appreciate that space 20 may be any space within which dehumidification is desired. As shown, dehumidification system 10 has a process air flow path 100, a regeneration air flow path 200, and a recirculation air flow path 204. The process air flow path 100 is for dehumidifying and conditioning air from the space 20 which is primarily accomplished through the use of a desiccant wheel 114. As shown, the process air flow path 100 is in fluid communication with process return air flow path 36 and a process supply air flow path 34. Paths 34 and 36 enable air to be continuously circulated between the process air flow path 100 and the space 20. Process air flow path 100 may also be placed in fluid communication with an ambient air flow path 38. As such, process air flow path 100 may consist of return air from the space 20 (via path 36), ambient air (via stream 38), or a combination of both.

In very general terms, the desiccant wheel 114 transfers moisture from the process air flow path 100 to the regeneration air flow path 200. The moisture is removed from the desiccant wheel 114 in the regeneration air flow path 200. Regeneration air flow path 200 is configured to receive an ambient air flow stream 30 and to exhaust an exhaust air flow stream 32. Regeneration air flow path 200 is also configured to recirculate air through the desiccant wheel 114 via a recirculation air flow path 204, as explained in more detail below. In one embodiment, about half of the desiccant wheel 114 is disposed in the regeneration air flow path 200 with the other half being in the process air flow path 100. In another embodiment, about a quarter of the desiccant wheel is in the regeneration air flow path 200 with the other portion being in the process air flow path 100. As such, the desiccant wheel 114 can be said to be partially disposed within the regeneration air flow path 200 and partially disposed within the process air flow path 100.

Figure 2:
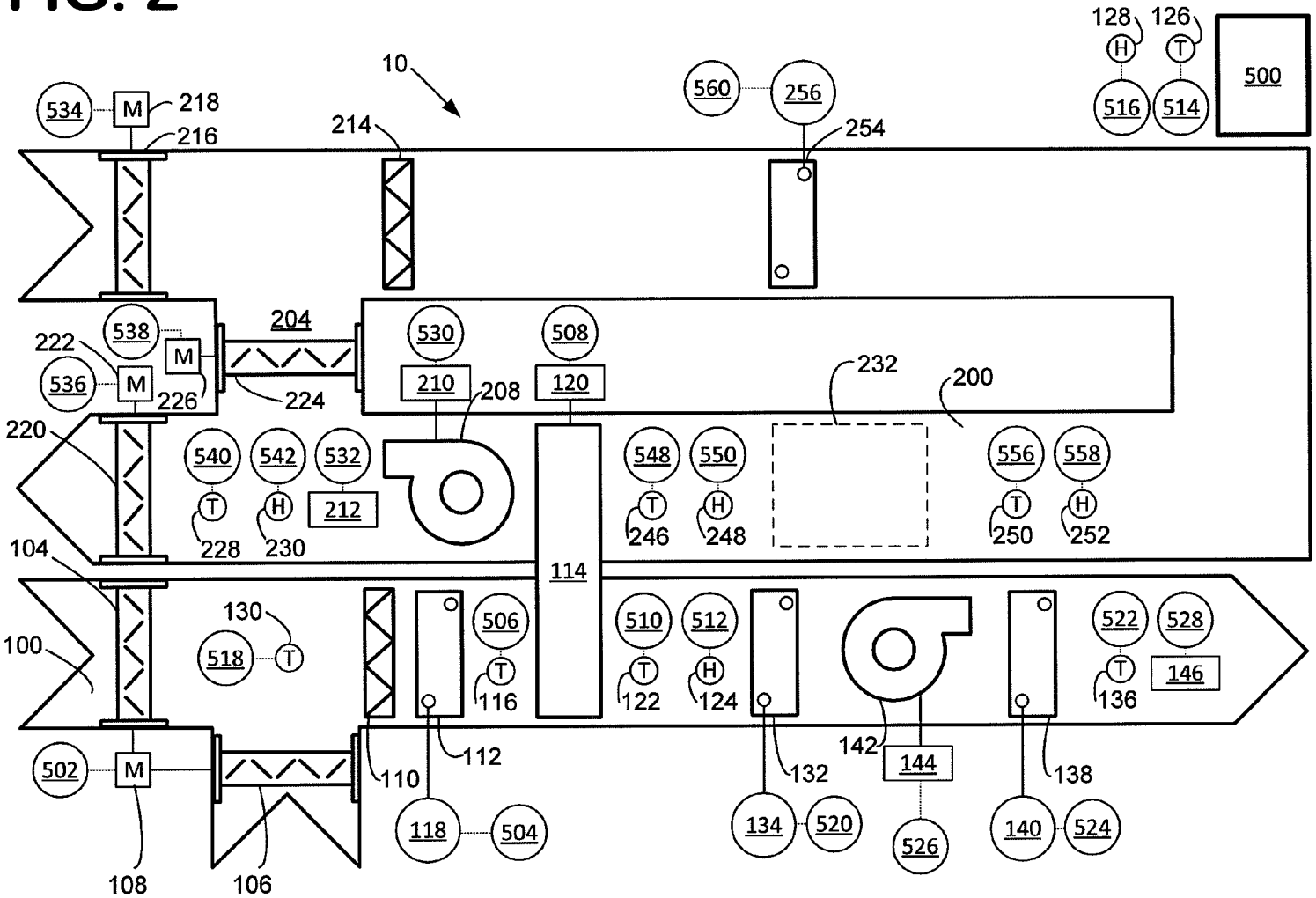
FIG. 2 is a schematic view of the dehumidification system shown in FIG. 1.

Referring to FIG. 2, the dehumidification system 10 is shown in further detail. As stated previously, process air flow path 100 is for removing moisture from space 20. In one embodiment, process air flow path 100 includes an outside air damper 104 and a return air damper 106 that are controlled by a motorized actuator 108. Motorized actuator 108 is controlled by an electronic controller 500, discussed later, via a control signal 502. In operation, motorized actuator 108 will cause damper 104 to open while simultaneously closing damper 106, and vice versa, to maintain a relatively constant amount of air flowing into process air flow path 100 at a given overall air flow rate. As such, process air flow path can consist of 100 percent return air, 100 percent ambient or outside air, or a combination of outside air and return air. In applications where outside air or ambient air is not required, process air flow path 100 need not be provided with dampers 104 and 106. However, under certain operating conditions, greater dehumidification of the space 20 may be achieved through the addition of ambient air. One skilled in the art will appreciate that dampers 104 and 106 could be independently controlled by separate motorized actuators and control signals. In one embodiment, an outside air temperature sensor 126 and/or an outside air humidity sensor 128, in communications with a controller 500 via control points 514, 516 respectively, may be utilized as inputs to the control system to aid in controlling the dampers 104, 106. In one embodiment controller 500 is a direct digital electronic controller. Also, dampers 104, 106 may be directly controlled to maintain a mixed air temperature set point, as measured by a mixed air temperature sensor 130 in communication with the controller 500 via control point 518.

Process air flow path 100 is additionally shown as including an optional filter 110. Filter 110 is for filtering the air to ensure that environmental contaminants are removed. Filter 110 may consist of a single filter element or may be a combination of filter elements, such as a pre-filter and a final filter. Filter 110 may also include any known type of filter media, such as depth media or pleated media. In one embodiment filter 110 is a 2" filter having a MERV (minimum efficiency reporting value) rating of 8. In applications where space 20 requires a high degree of cleanliness, a filter having a MERV rating of 16-20 or a HEPA rated filter may also be utilized.

Process air flow path 100 may include an optional pre-cooling coil 112. Pre-cooling coil 106 may be any type of cooling coil known in the art. Pre-cooling coil 112 is for removing moisture from the air flowing in the process air flow path 100 upstream of the desiccant wheel 114. Examples of cooling coils suitable for use as coil 112 include chilled water coils and evaporator coils from a direct expansion type refrigerant system. In general, as air passes through pre-cooling coil 112 the air is cooled below its dew point such that moisture condenses out of the air and onto cooling coil 112 where it can be subsequently drained away. The capacity of the pre-cooling coil 112 can be controlled by a control element 118 operated by a control point 504 in communication with controller 500. In one embodiment, control element 118 is a compressor output while in another embodiment element 118 is a chilled water control valve. In one embodiment, a temperature sensor 116 can be provided to monitor and/or control the output of the pre-cooling coil 112. In such an application, the temperature sensor 116 can be placed in communication with the controller 500 via control point 506 and the output of the control element 118 can be adjusted to maintain a discharge air temperature set point.

As stated previously, a desiccant wheel 114 is provided in the process air flow path 100. One type of desiccant wheel suitable for use as desiccant wheel 114 is a hydrothermally stabilized silica gel desiccant wheel. Desiccant wheels operate to absorb the moisture content of an air flow stream and will desorb moisture, or regenerate, when exposed to a heated air flow stream. By rotating a desiccant wheel between two air flow streams, moisture can be transferred from one air stream to the other. A desiccant wheel can also transfer sensible heat from one air flow path to another. In the embodiment shown, the air conditions in the regeneration air flow path 200 are deliberately controlled to affect a transfer of moisture from the process air flow stream 100 via the desiccant wheel 114. One skilled in the art will appreciate that other types of desiccant wheels 114 may be used.

The rate of moisture removal performed by the desiccant wheel 114 may be controlled by adjusting the speed of rotation of the wheel, by changing the flow through the wheel, or by altering the conditions of the air flowing through the regeneration air flow path 200. In one embodiment, wheel is controlled by a drive element 120. Drive element 120 may be commanded on and off and/or may be configured to vary the speed of the wheel 114 through the use of a variable frequency drive (VFD). Drive element 120 may be placed in communication with the controller 500 via control point 508. As an input to the control for the desiccant wheel a temperature sensor 122 and/or a humidity sensor 124 may be placed in communication with the controller 500 via control points 510 and 512, respectively.

Process air flow path may optionally also include a post-cooling coil 132 downstream of the desiccant wheel 114. Post-cooling coil 132 is for reducing the air temperature of the air after it has passed through the desiccant wheel 114. As the air within the regeneration air flow path 200 is warmer than that within the process air flow path 100, the desiccant wheel 114 will operate to heat up the process air. As such, post-cooling coil 132 can be utilized to bring the final discharge air temperature down to a desirable level for introduction into space 20 (i.e. to provide neutral air or air conditioning). The capacity of the post-cooling coil 132 can be controlled by a control element 134 operated by a control point 520 in communication with controller 500. In one embodiment, control element 134 is a compressor output while in another embodiment element 134 is a chilled water control valve. In one embodiment, a discharge air temperature sensor 136 can be provided to monitor and/or control the output of the post-cooling coil 132. In such an application, the temperature sensor 136 can be placed in communication with the controller 500 via control point 522 and the output of the control element 134 can be adjusted to maintain a discharge air temperature set point.

Process air flow path may optionally also include a heating coil 138 downstream of the desiccant wheel 114. Heating coil 138 is for increasing the air temperature of the air after it has passed through the desiccant wheel 114. Heating coil 138 may be a steam coil, a hot water coil, an electric coil, a condenser coil of a refrigeration system, or a gas fired heater. Heating coil 138 may also utilize a waste heating source for heat, for example waste heat from a refrigeration system. During some conditions and applications, it is necessary to provide air of a sufficient temperature to the space 20, such as when system 10 is responsible for heating the space 20. The capacity of the heating coil 138 can be controlled by a control element 140 operated by a control point 524 in communication with controller 500. In one embodiment, control element 140 is a heating valve for a hot water or steam coil while in another embodiment element 140 is an SCR control for an electric coil. Where a gas fired heater is utilized, control element 140 can be a gas valve. In one embodiment, the discharge air temperature sensor 136 can be provided to monitor and/or control the output of the heating coil 138.

Alternatively, or in addition to temperature sensors 122, 136 and humidity sensor 124, a temperature sensor 22 and/or humidity sensor 24 could be located in the space 20, as illustrated in FIG. 1. In such applications, sensors 22/24 can be placed in communication with the controller 500 via control points 552 and 554 and the output of the components (108, 112, 114, 132, 136, etc.) in the process air flow path 100 can be adjusted to maintain a space temperature and/or humidity set point, or at least serve as variables within the control algorithm for operation of the system 10.

In order to circulate air between space 20 and the process air flow path 100, a process air fan 142 is provided. In one embodiment, process air fan 142 is controlled by a drive element 144. Drive element 144 may be commanded on and off, and/or may be configured to vary the speed of the fan 142 through the use of a variable frequency drive (VFD). Drive element 144 may be placed in communication with the controller 500 via control point 526. As an input to the control for the process air fan 142 a sensing device 146 may be placed in communication with the controller 500 via control point 528. Examples of sensing device 146 are a duct static pressure sensor and an air flow measuring station, either of which could be used as feedback for maintaining a control set point.

Referring to FIGS. 1 and 2, regeneration air flow path 200 is shown within which air flows in a direction 202. In order to circulate air through the regeneration air flow path 200, a regeneration air fan 208 is provided. In one embodiment, regeneration air fan 208 is controlled by a drive element 210. Drive element 210 may be commanded on and off, and/or may be configured to vary the speed of the fan 208 through the use of a variable frequency drive (VFD). Drive element 210 may be placed in communication with the controller 500 via control point 530. As an input to the control for the regeneration air fan 208 a sensing device 212, for example an air flow station, may be placed in communication with the controller 500 via control point 532. Regeneration air fan 208 may also be controlled to maintain a speed that will provide for more or less dehumidification or to ensure that the refrigeration system 232 operates within its operating envelope 302, discussed later.

Regeneration air flow path 200 also includes a filter 214. Filter 214 is for filtering the entering ambient air flow stream 30, and any recirculated air, to ensure that environmental contaminants are removed. Filter 214 may consist of a single filter element or may be a combination of filter elements, such as a pre-filter and a final filter. Filter 214 may also include any known type of filter media, such as depth media or pleated media. In one embodiment filter 214 is a 2" filter having a MERV (minimum efficiency reporting value) rating of 8. Other filters may be used.

Figure 3:
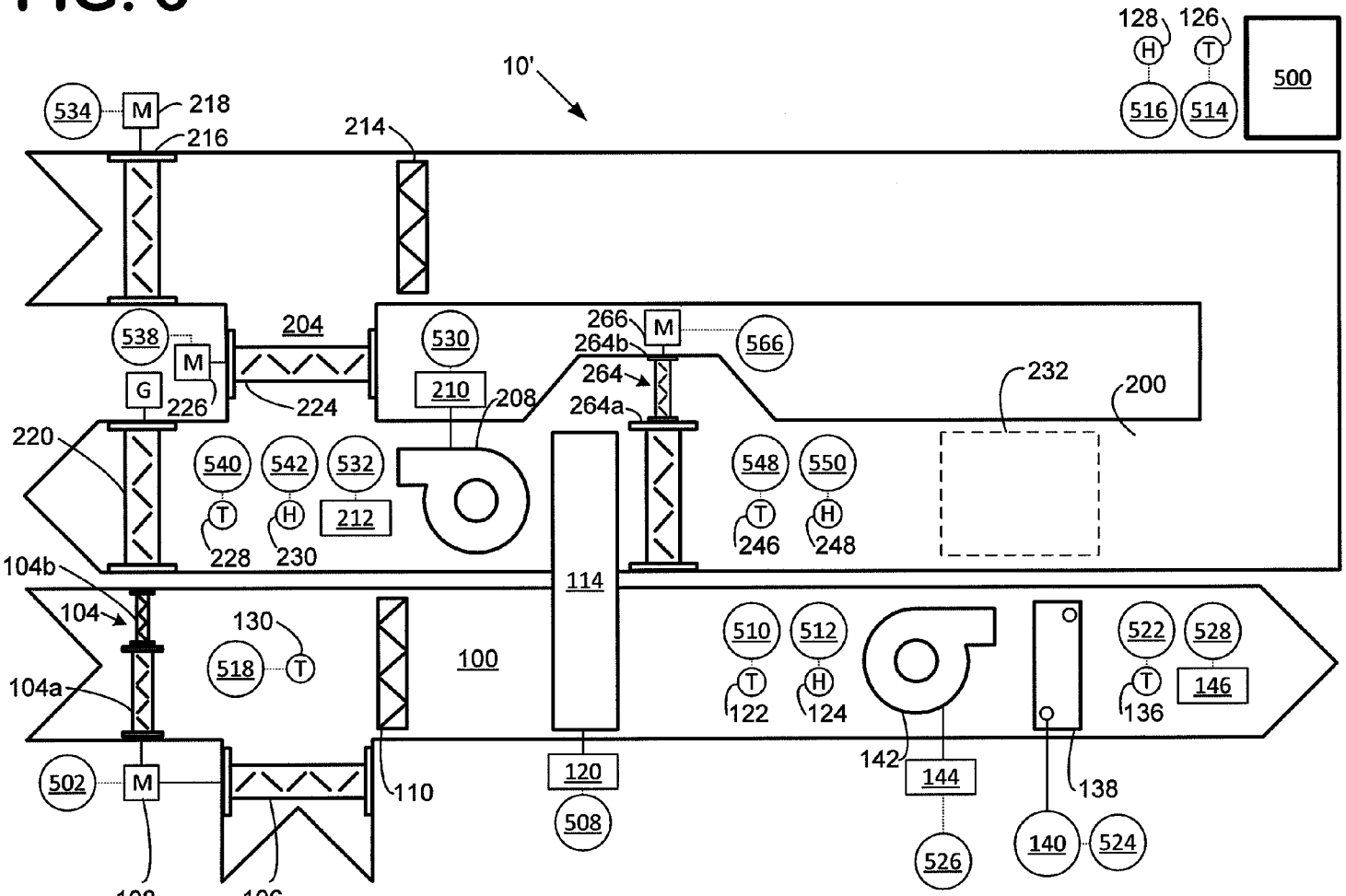
FIG. 3 is a schematic view of a second embodiment of a dehumidification system.

In order to allow ambient air to enter into and exhaust from the regeneration air flow path 200, dampers 216 and 220 are provided, respectively. Outside air damper 216, is operated by an actuator 218 that is in communication with controller 500 via control point 534 while exhaust air damper 220 is operated by an actuator 222 in communication with controller 500 via control point 536. A recirculation air damper 224 is also provided in the recirculation air flow path 204. Recirculation damper 224 is operated by an actuator 226 in communication with controller 500 via control point 538. In operation, the outside air damper 216 and the exhaust air damper 220 will generally open and close together to enable the same volume air to enter and exhaust the regeneration air flow path 200 at a given regeneration air fan flow rate. It is noted that damper 220 may also be a gravity operated damper, as shown in FIG. 3.

When operating in a full recirculation mode, discussed later, the recirculation damper 224 will fully open to ensure that all of the air that has been passed through the desiccant wheel 114 is recirculated and delivered back to the regeneration air flow path 200 upstream of the desiccant wheel 114, more specifically upstream of the refrigeration system 232. In a mixed air mode, the recirculation damper 224 will cooperatively operate with the outside and exhaust air dampers 216, 220 to ensure a desired ratio of recirculation air and outside ambient air 30 are delivered upstream of the refrigeration system 232, discussed later. In general, the recirculation damper 224 and the exhaust air damper 220 cooperatively operate in opposite directions such that when the recirculation damper 224 is fully open (recirculation mode), the exhaust air damper 220 is fully closed, and vice versa. The dampers 220, 224 would likewise be modulated between the fully open and closed positions in the mixed air mode. Due to this operation, one skilled in the art will appreciate that dampers 220, 224 could be operated by the same actuator.

The recirculation air flow path 204 may also include a heating coil 254. Heating coil 254 is for increasing the air temperature of the air after it has passed through the desiccant wheel 114. The primary purpose of such a coil would be to accelerate the rise in temperature of the regeneration air in order to reach maximum dehumidification capacity. Heating coil 254 may be a steam coil, a hot water coil, or an electric coil. Heating coil 254 may also utilize a waste heating source for heat, such waste heat from an ice rink refrigeration system. The capacity of the heating coil 254 can be controlled by a control element 256 operated by a control point 560 in communication with controller 500. In one embodiment, control element 256 is a heating valve for a hot water or steam coil while in another embodiment element 256 is an SCR control for an electric coil. In one embodiment, a discharge air temperature sensor 250 can be provided to monitor and/or control the output of the heating coil 254. Also, the heating coil may be placed in the regeneration air flow path 200 at any location upstream of the desiccant wheel 114, if desired.

The regeneration air flow path 200 may also include a number of sensors for monitoring and/or controlling the system 10. In one embodiment, the temperature and/or humidity of the air downstream of the desiccant wheel 114 may be measured, as provided for by sensors 228 and 230, respectively. These sensors could also be located upstream or downstream of the regeneration fan 208 or within the regeneration air flow path 204. In the embodiment shown, sensors 228 and 230 are in communication with controller 500 via control points 540 and 542, respectively. The system 10 may also measure temperature and humidity of the air upstream of the refrigeration system 232, as measured by sensors 250 and 252, respectively. In the embodiment shown, sensors 250 and 252 are in communication with controller 500 via control points 556 and 558, respectively. System 10 may also include temperature and humidity sensors 246, 248 downstream of the refrigeration system 232 and in communication with the controller 500 via control points 548 and 550, respectively. One skilled in the art will appreciate that additional sensors and sensor types may be provided within system 10.

Regeneration air flow path 200 also includes refrigeration system 232. Refrigeration system 232 is shown in detail at FIG. 5. In the embodiment shown, refrigeration system includes an evaporator coil 234 upstream of a condenser coil 236. Refrigeration system 232 also includes a compressor 238 and an expansion device 240. In one embodiment, the compressor 238 is in the regeneration air flow path 200 where it can be cooled. The compressor 238 is placed in communication with the coils 234 and 236 via refrigeration line 242 while the expansion device 240 is placed in communication with the coils 234 and 236 via refrigeration line 244. Compressor 238 can be placed in communication with the controller 500 via control points 544. Refrigeration system 232 additionally includes a temperature sensor 262 in direct communication with the expansion device 240. In the embodiment shown, sensor 262 is a capillary tube temperature sensing device and expansion device 240 is a thermal expansion device. Where an electronic expansion valve is used instead of a thermal expansion valve, the control system can additionally control and communicate with the electronic expansion valve and an electronic temperature sensor at the general location of sensor 262.

Also shown in refrigeration system 232 is a pressure sensor 258 downstream of the condenser 236 in communication with the controller 500 via control point 562 and a pressure sensor 260 downstream of the evaporator 234 in communication with the controller 500 via control point 564. In operation, the leaving condensing and evaporator pressures, as measured at sensors 258 and 260, can be converted to temperature values based on the type of refrigerant used. As such, the aforementioned components allow for the expansion device 240 to be controlled to ensure that the refrigerant leaving the evaporator is superheated as a vapor and for the compressor 238 to be operated within its operating envelope and to achieve the desired output capacity.

In very general terms, the compressor 238 compresses a refrigerant in refrigeration line 242. Compressor 238 may include one or more compressors. Additionally, compressor 238 may be a variable output compressor. By use of the term "variable output compressor", it is meant to include any compressor that can actively vary output capacity, for example a digital scroll compressor or a variable speed compressor. As the refrigerant is compressed, its pressure and temperature are increased. The condenser coil 236 receives the compressed refrigerant, which is in a vapor form, and reduces its temperature sufficiently to condense the refrigerant into liquid form. By doing so, the condenser coil 236 transfers heat from the refrigerant to the air flowing in the regeneration air flow path 200. Expansion device 240, such as a thermal expansion valve, receives the liquid refrigerant from the condenser coil 236 and lowers the pressure and thereby the temperature of the refrigerant sufficiently to transform the refrigerant into vapor-liquid form. Subsequently, the refrigerant is delivered to the evaporator coil 234 where the refrigerant is fully transformed back into vapor form. As part of this process, heat is absorbed by the refrigerant and removed from the air passing through the evaporator coil 234 in the regeneration air flow path. Due to the refrigerant temperature within evaporator coil 234, moisture in the air passing through the evaporator coil 234 is condensed and subsequently drained away. Finally, the refrigerant is delivered from the evaporator coil 234 to the compressor 238 where the refrigeration cycle is repeated. The net result of the configuration, as will be explained in detail later, is that the ambient air flow stream 30 entering the regeneration air flow path 200 is cooled and dehumidified by the evaporator coil 234 and then reheated by the condenser coil 236. This results in a relatively dry and warm air stream that maximizes the moisture removal capacity of the desiccant wheel 114.

Figure 6:
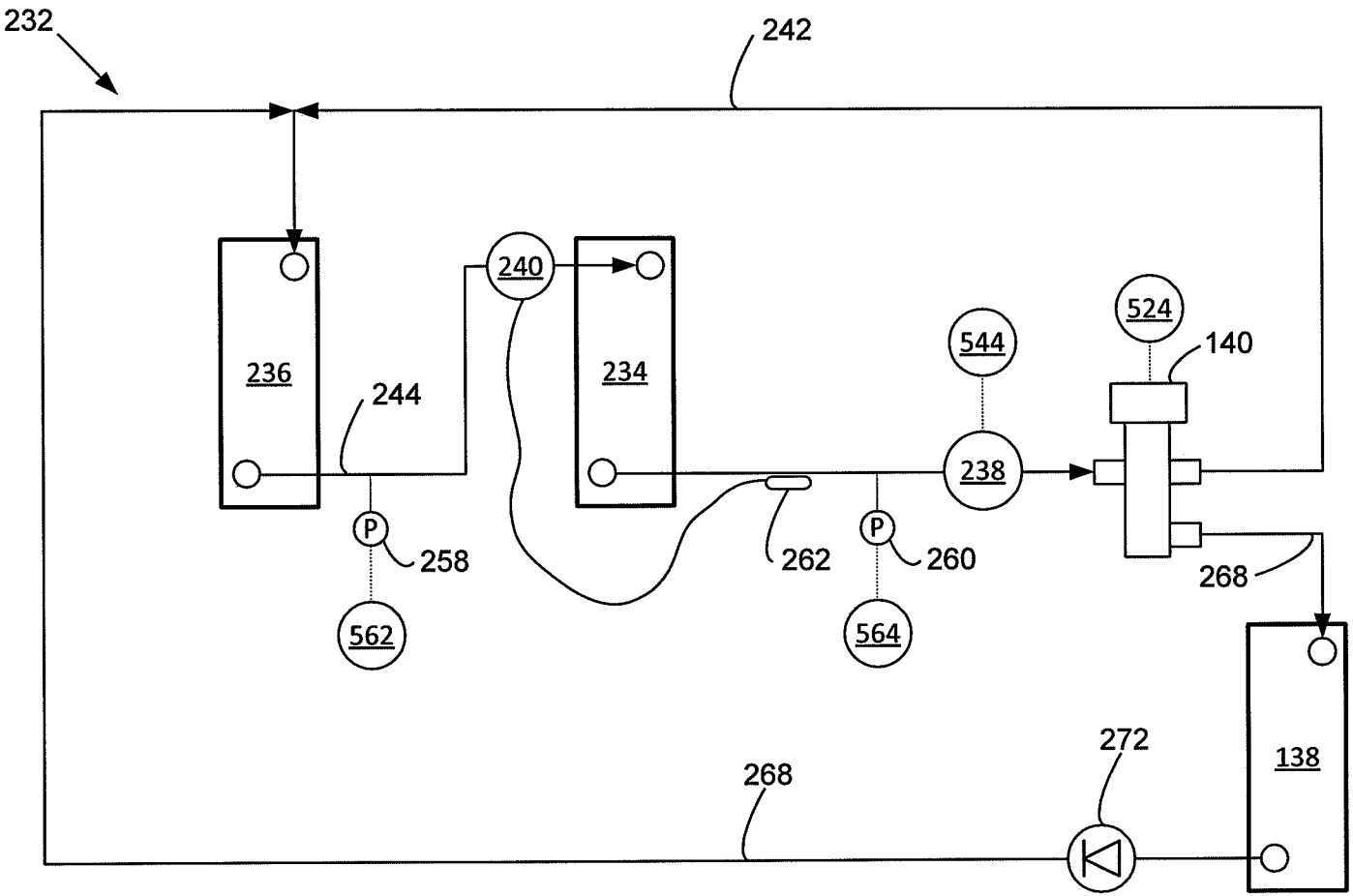
FIG. 6 is a schematic view of the refrigeration system shown in FIG. 4 including a second condenser coil in the process air flow path.

With reference to FIG. 6, the refrigeration system 232 is further shown as optionally including heating coil 138, which is in the process air flow path 100. In the embodiment shown, heating coil 138 is a condenser coil connected at its inlet to compressed refrigerant line 242 via a three-way valve 140 and refrigerant line 268. The three-way valve 140 can be controlled by the controller 500 via control point 524 and can selectively divert refrigerant to coil 138. The outlet of the coil 138 is connected to refrigerant line 242 downstream of the three-way valve 140 such that the refrigerant leaving coil 138 is directed into condenser coil 236. Also, refrigerant line 268 has a check valve 272 to ensure that refrigerant does not flow in the reverse direction into coil 138.

With the configuration shown in FIG. 6, the refrigerant system 232 can be selectively operated to direct some of the condensing load onto coil 138 that would otherwise be handled by coil 236. This results in a lower leaving coil temperature from coil 236 and in heat being provided to the process air flow path 100. By lowering the leaving air temperature from coil 236 and rejecting heat into the process air flow path 100, the load on the compressor 238 can be reduced. In one embodiment, the three-way valve 140 can be modulated to ensure that the refrigeration system 232 is operated within its operating envelope 302, as discussed in the following paragraphs.

Figure 5:
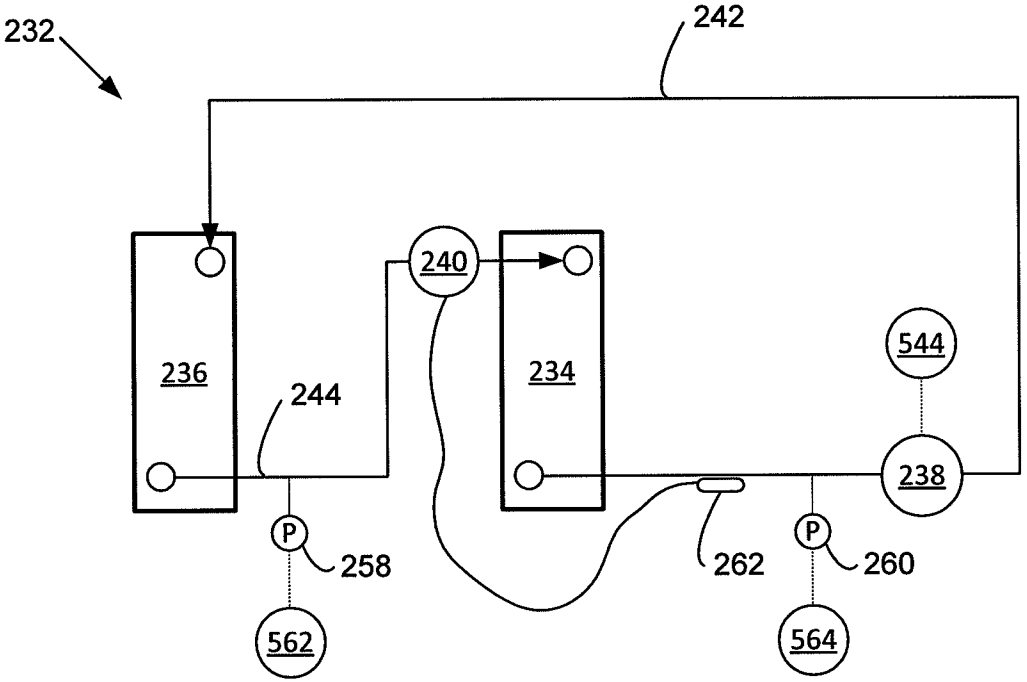
FIG. 5 is a schematic view of a refrigeration system suitable for use in the dehumidification systems disclosed herein.
Figure 7:
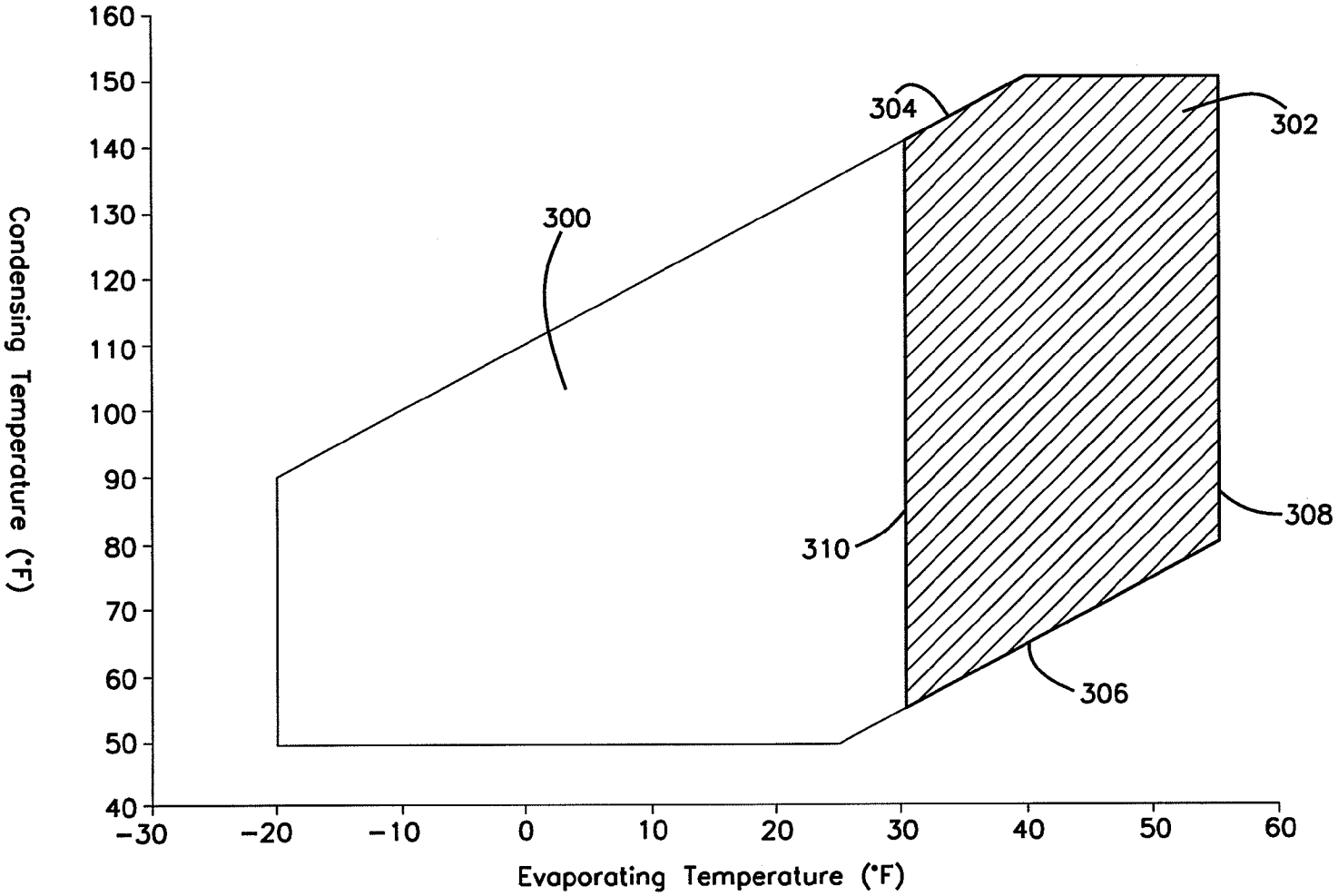
FIG. 7 is a schematic chart of an operating envelope for a refrigeration system suitable for use in the dehumidification systems disclosed herein.

With reference to FIG. 7, the refrigeration system 232 should be operated within an operating envelope 300. By use of the term "operating envelope" it is meant that the operation of the refrigeration system 232 is limited to a general range of refrigerant evaporating and condensing temperatures to ensure satisfactory operation and safety of the equipment. The boundaries of the operating envelope are a function of the compressor type, the refrigerant type, and the design criteria for the system 10. In one embodiment, the refrigerant is R410A and the compressor 238 is a scroll compressor, as depicted in FIG. 5. Other refrigerants may be used.

FIG. 7 shows an operating envelope 300 for the scroll compressor itself and a reduced operating envelope 302 for the combination of a scroll compressor utilizing a particular refrigerant. In the embodiment shown, the refrigerant is R410A. In such an embodiment, the operating envelope includes a minimum evaporating temperature line 310 and a maximum evaporation temperature line 308. In the embodiment shown, temperature 310 is about 32 degrees F. while temperature 308 is about 55 degrees F. In certain conditions, the minimum evaporating temperature 310 must be at least 32 degrees in order to prevent the moisture that is condensing on the evaporator coil 234 from freezing on the coil. However, under certain conditions, the minimum evaporator temperature 310 can be set to as low as 20 degrees F. The operating envelope 302 also has a minimum condensing temperature line 306 and a maximum condensing temperature line 304. In the embodiment shown, temperature line 306 varies from about 55 degrees F. to about 80 degrees F. (varies) and maximum condensing temperature line varies from about 140 degrees F. to about 150 degrees F.

Referring back to FIG. 3, a second embodiment of a dehumidification system 10' is presented. As many of the concepts and features are similar to the first embodiment shown in FIG. 2, the description for the first embodiment is hereby incorporated by reference for the second embodiment, and vice-versa. Where like or similar features or elements are shown, the same reference numbers will be used where possible. The following description for the second embodiment will be limited primarily to the differences between the first and second embodiments.

In the embodiment shown in FIG. 3, the regeneration air flow path 200, and the associated components therein, is the same as that shown in FIG. 2. In the process air flow path 100, the primary difference is that optional pre-cooling coil 112 and optional post-cooling coil 132 are not installed. As such, the system 10 shown in FIG. 3 is entirely reliant upon the desiccant wheel 114 for dehumidification and cannot provide mechanical cooling to the space 20.

Another difference between FIGS. 2 and 3 is that damper 104 is explicitly shown as having a minimum outside air damper **104*b* and a maximum outside air damper 104*a*. It is noted that the system shown in FIG. 2 is only a schematic representation and may also have a minimum and maximum outside air damper. Minimum outside air damper 104*b* is generally smaller than the maximum outside air damper and is utilized during periods of low flow. Periods of low flow would include periods where the outside air is only a fraction of the total air volume moved by process air fan 142 and/or when the process air fan 142 is running at a relatively low speed. By incorporating a minimum outside air damper, better damper control is obtained due to the increased air velocity across the outside air damper, as compared to utilizing the entire area of both dampers. The maximum outside air damper 104*a* is configured to open once the minimum outside air damper 104*b* has reached is maximum position and further airflow is still required, such as in an economizer mode. FIG. 3 also shows exhaust damper 220** as being a gravity operated damper instead of an actuated damper.

Yet another difference between the embodiments of FIGS. 2 and 3, is that heating coil 254 is no longer present in the embodiment shown in FIG. 3 and that a face and bypass damper assembly 264 is installed. As shown, the face and bypass damper assembly 264 includes a face damper **264*a* and a bypass damper 264*b* that can be selectively operated to direct any ratio of air through or around the desiccant wheel 114. The damper assembly 264 may be operated by a motorized actuator 266 connected to the controller 500 at control point 566. The function of the face and bypass damper assembly 264 is similar to that of the heating coil 254 in that the time to reach the desired regeneration temperature can be decreased. With the face and bypass damper assembly 264, this is accomplished by placing the unit into full recirculation mode and bypassing all of the air around the desiccant wheel 114 such that the regeneration air is not cooled and humidified by the wheel 114. Once a desired regeneration temperature is attained, the regeneration air can be directed either partially or wholly through the wheel 114 such that dehumidification of the process air flow stream can occur. It is also noted that dehumidification system 100 may include both the heating coil 254 shown in FIG. 2 and the face and bypass assembly 264 shown in FIG. 3. It is also noted that any of the previously discussed configurations of the refrigeration system 232 shown in FIGS. 5 and 6** may be used with this embodiment.

Figure 4:
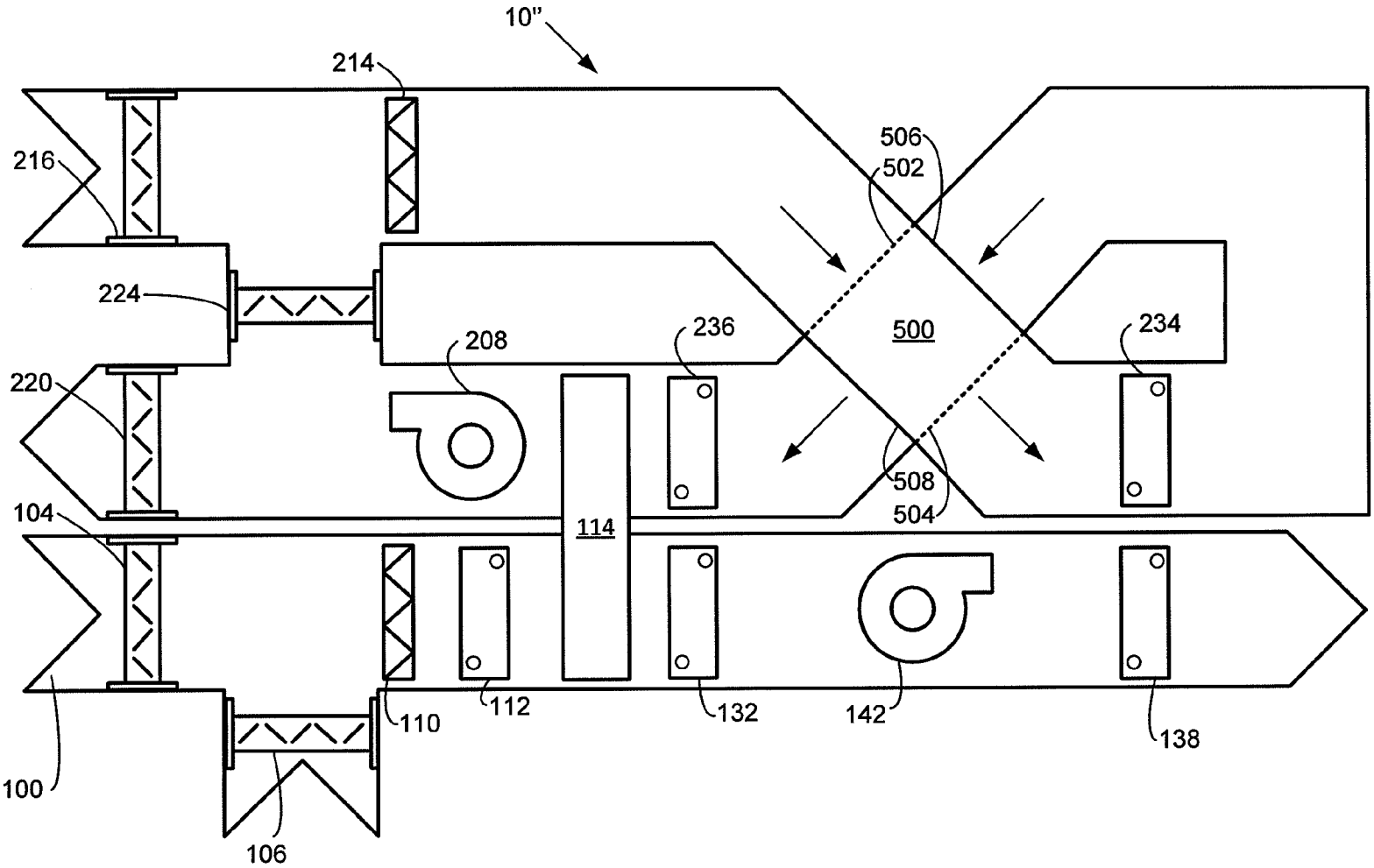
FIG. 4 is a schematic view of a third embodiment of a dehumidification system.

Referring to FIG. 4, a third embodiment of a dehumidification system 10" is presented. As many of the concepts and features are similar to the embodiments shown in FIGS. 2 and 3, the description for the first and second embodiments is hereby incorporated by reference for the third embodiment, and vice-versa. Where like or similar features or elements are shown, the same reference numbers will be used where possible. The following description for the third embodiment will be limited primarily to the differences between the first and second embodiments.

In the embodiment shown in FIG. 4, the process air flow path 100, and the associated therein, is the same as that shown in FIG. 2. In the regeneration air flow path 200, the primary difference is that a supplemental heat exchanger 500 is provided between the evaporator coil 234 and the condenser coil 236 of the refrigeration system 232. In the embodiment shown, the heat exchanger 500 is an air-to-air fixed plate heat exchanger including a first air flow path defined by a first inlet 502 and a first outlet 504 and a second air flow path defined by a second inlet 506 and a second outlet 508. The first and second air flow paths are separated by internal plates in the heat exchanger 500. In operation, air flowing through the first air flow path will exchange heat with air flowing through the second air flow path. As configured, the air from the recirculation air flow path 204 and/or ambient air 30 from outdoors is directed into first inlet 502 and out of first outlet 504 of heat exchanger 500.

After passing through this first air flow path, the air is directed through evaporator coil 234 and through the second air flow path via second inlet 506 and outlet 508. After the air leaves the second outlet 508, it is directed to the condenser coil 236. As arranged, the air flowing into first inlet 502 is cooled by the air flowing into second inlet 506 which has been cooled by the evaporator 234. Conversely, the air flowing into the second inlet 506 is heated by the air flowing into the first inlet 502. Thus, the air leaving the first outlet 504 is in a pre-cooled state for evaporator 234 while the air leaving second outlet 508 is in a pre-heated state for the condenser coil 236. This pre-heating and pre-cooling effect provided by heat exchanger 500 can significantly reduce the load on the compressor 238. It is also noted that any of the previously discussed configurations of the refrigeration system 232 shown in FIGS. 5 and 6 may be used with this embodiment.

Although a fixed plate heat exchanger is described above for heat exchanger 500, any other type of air-to-air heat exchanger may also be used. Non-limiting examples of heat exchangers that may be used are a sensible only heat wheel, a heat pipe system, and a run around coil loop. One skilled in the art will readily recognize these types of heat exchangers and others as being useful in relation to the disclosed concepts herein.

Referring to FIGS. 8-18, a continuous regeneration operating process 1000, and variations thereupon, is shown. FIGS. 8-14 show psychrometric diagrams of the process 1000 at various states while FIGS. 15-18 show the process 1000 in schematic form. It is noted that the dehumidification capacity of the desiccant wheel 114 is most dependent on the temperature of the regeneration air stream, then the humidity level of the regeneration air stream, and then the amount of air flow of regeneration air stream. The dehumidification capacity of the system 10 can be selectively operated to match the dehumidification load of the space 20 or can be operated to achieve maximum dehumidification. In the example provided, the airflow volumetric flow rate in the regeneration air flow path 200 is about half of that of the airflow in the process air flow path 100. However, one skilled in the art will appreciate that other ratios of regeneration air to process air may be used, such as a 1:1 ratio, a 1:3 ratio, and a 1:4 ratio.

Figure 8:
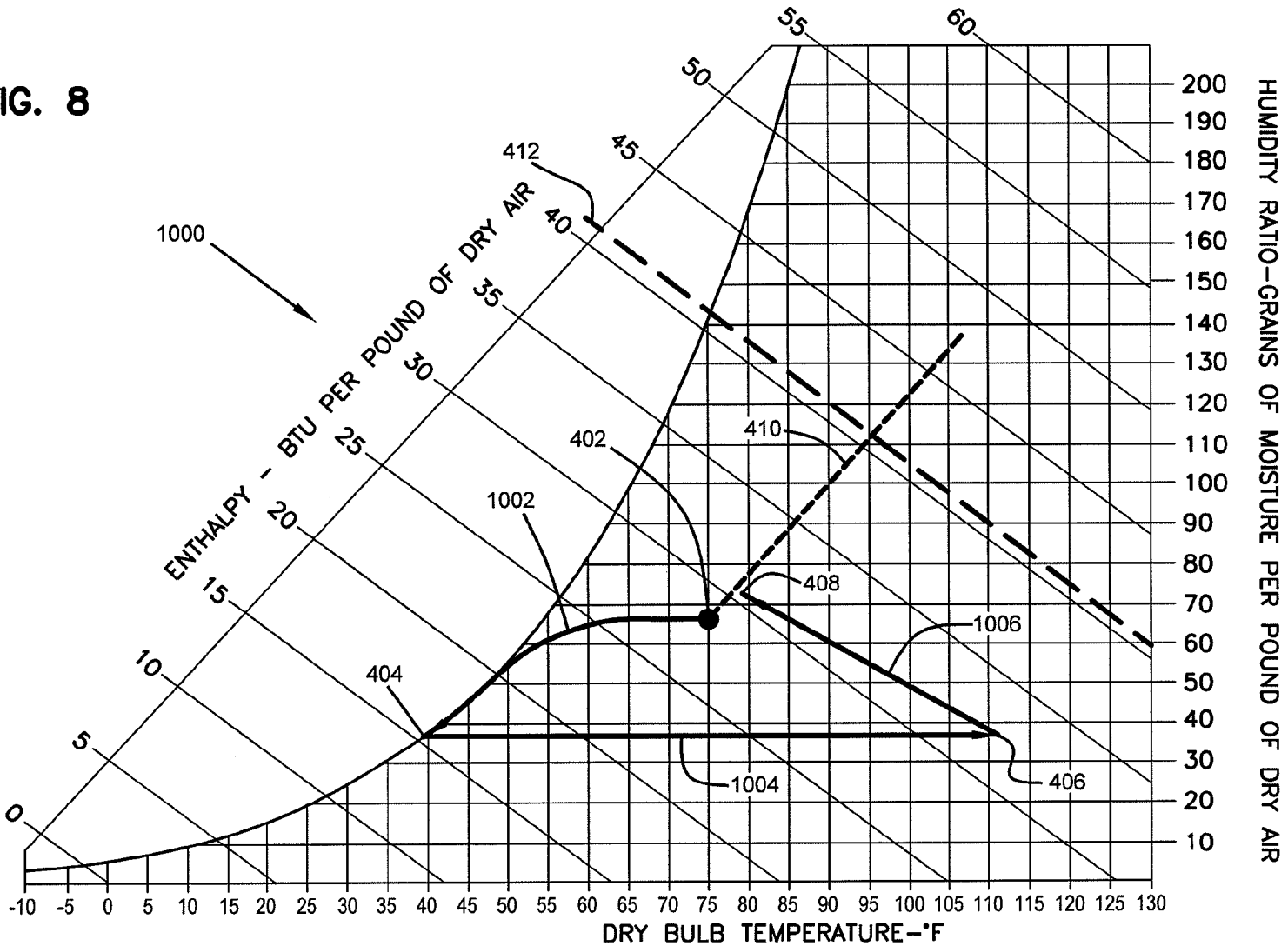
FIG. 8 is a psychrometric chart showing an exemplary process that can be implemented by the dehumidification systems disclosed herein.

Referring to FIG. 8, a first step 1002 of the process 1000 is shown. At step 1002, a regeneration air flow stream is conditioned by the evaporator coil 234 of the refrigeration system 232 in the regeneration air flow path 200. With reference to FIG. 8 specifically, an initial starting condition 402 for the air flow stream is chosen, for the purpose of explanation, as being about 75 degrees F. at about 64.4 grains of moisture per pound of dry air ("grains moisture"). However, it should be understood that any reasonable starting condition 402 starting point could be initially utilized. As the air passes through the evaporator coil 234, the air is cooled and dehumidified by condensing moisture out of the air flow stream to a second condition 404. Still referring to FIG. 8, the air can be conditioned, for example, down to about 39.7 degrees F. at about 34.4 grains in a first pass of the process 1000 when starting from initial condition 402.

In a second step 1004 of the process, the cooled and dehumidified air is passed through the condensing coil 236. At this step, the air is sensibly heated to a third condition 406 by the condensing coil 236. Referring to FIG. 8, the air can be heated to about 111 degrees F. in a first pass of the process 1000 when starting from condition 404.

In a third step 1006 of the process 1000, the now heated air is passed through the desiccant wheel 114. At this step, the air is both cooled and humidified to a fourth condition 408 by the desiccant wheel 114. Referring to FIG. 8, the air can be conditioned to about 79.2 degrees F. and 71.3 grains moisture in a first pass of the process 1000 when starting from condition 406.

Figure 15:
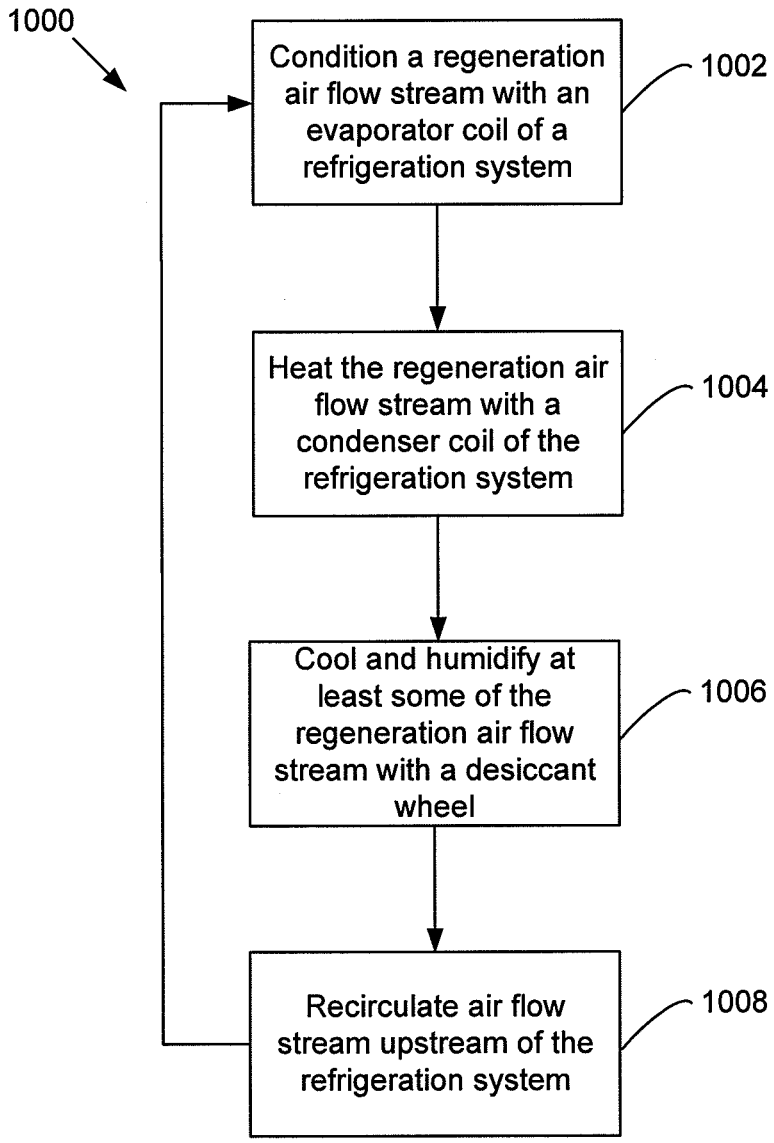
FIG. 15 is a schematic process flow diagram generally showing at least some of the process steps illustrated in FIGS. 8-14.

In a step 1008, shown at FIG. 15, the air is recirculated back to upstream of the evaporator coil 234 where the process can continue again at step 1002. However, in a second pass, the starting point for step 1002 would be condition 408. As can be readily seen at FIG. 8, the fourth condition 408 is shifted upward and to the right of the first condition 402. This shift is due to the fact that, in this example, the desiccant wheel 114 has added more moisture in step 1006 than the evaporator coil 234 removed in step 1002. The shift is also caused because the net sensible temperature gain caused by the condenser coil 236 and evaporator coil 234 in steps 1002 and 1004 has exceeded the sensible temperature reduction caused by the desiccant wheel 114 in step 1006. Where such an imbalance in the system exists, and the where the regeneration air is recirculated back to the evaporator in a step 1008, the starting point for step 1002 at each pass is shifted along iteration line 410 as process 1000 continues through multiple passes. It is noted that the process 1000 may be operated in a balanced state such that no temperature or humidity shift occurs, as may often be the case when a partial cooling and/or dehumidification load exists for the space 20.

Under certain conditions, the process 1000 shown in FIG. 8 can continue to the point where the leaving air conditions of the desiccant wheel 114 (i.e. the entering conditions for the evaporator coil 234) have shifted to the point where the refrigeration system 232 would be forced to operate beyond the operating envelope 302. Referring to FIG. 8, line 412 shows the maximum evaporator entering air condition corresponding to the operating envelope 302 upper boundary, beyond which the refrigeration system 232 would not be able to operate. As such, line 412 represents the maximum capacity of the refrigeration system 232 and also represents the condition at which maximum dehumidification can be provided. Line 412 may be interchangeably referred to as the maximum dehumidification line, the maximum refrigeration capacity line, or the maximum operating envelope condition line. In the example shown, line 412 extends generally parallel to the enthalpy lines on the psychrometric chart at an enthalpy value of about 41 btu's (British thermal unit) per pound of dry air.

Figure 9:
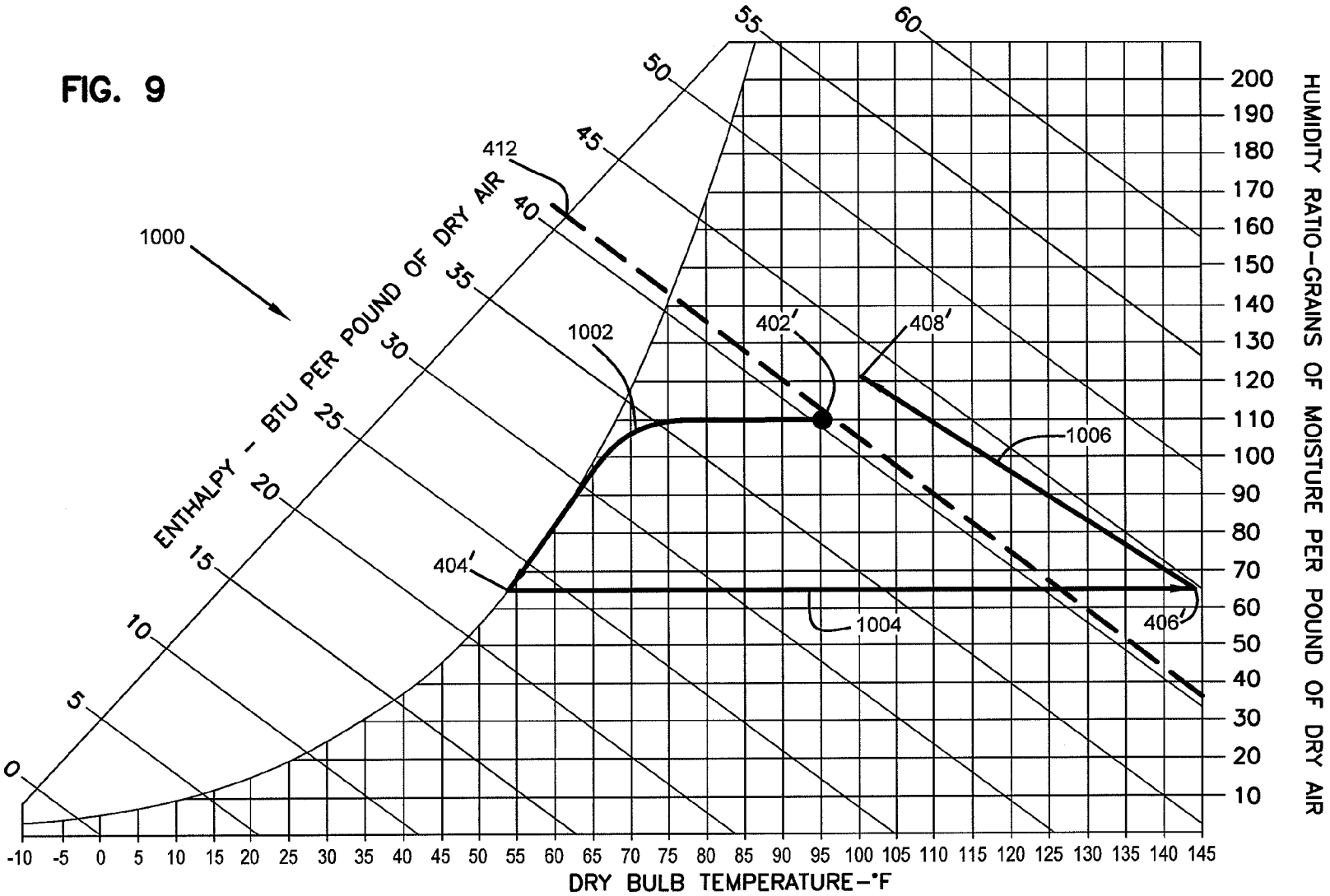
FIG. 9 is a psychrometric chart showing the exemplary process of FIG. 8 at a different state of operation.

FIG. 9 shows the process 1000 after the process has shifted through several iterations along iteration line 410. In the embodiment shown, the desiccant wheel 114 is rotating at about seven rotations per hour and the ending condition 408' shown in FIG. 7 is at a point after which the desiccant wheel 114 has rotated through about six revolutions. As shown, first condition 402', which is the ending state of the previous iteration, is about 95.9 degrees F. at about 109.3 grains moisture while second condition 404' is about 59.0 degrees F. at 71.5 grains moisture. Third condition 406' is about 144.9 degrees F. at 71.5 grains moisture while fourth condition 408' is about 100.5 degrees F. at 121.7 grains moisture. As can be seen, first condition 402' is just below the maximum operating conditions for the refrigeration system 232 while the fourth condition 408' is well beyond the capacity of the refrigeration system 232.

Once the system has reached the point where the leaving conditions from the desiccant wheel 114 exceed line 412, the cooling load on the refrigeration system 232 must be reduced in order for process 1000 to continue. Alternatively, the cooling load may need to be reduced under line 412 in order to match a submaximal dehumidification load of the process airflow stream. There are at least two approaches that can be utilized to ensure the refrigeration system 232 remains within its operating envelope 302 and/or to arrest the incremental iteration of the process along line 410.

Figure 10:
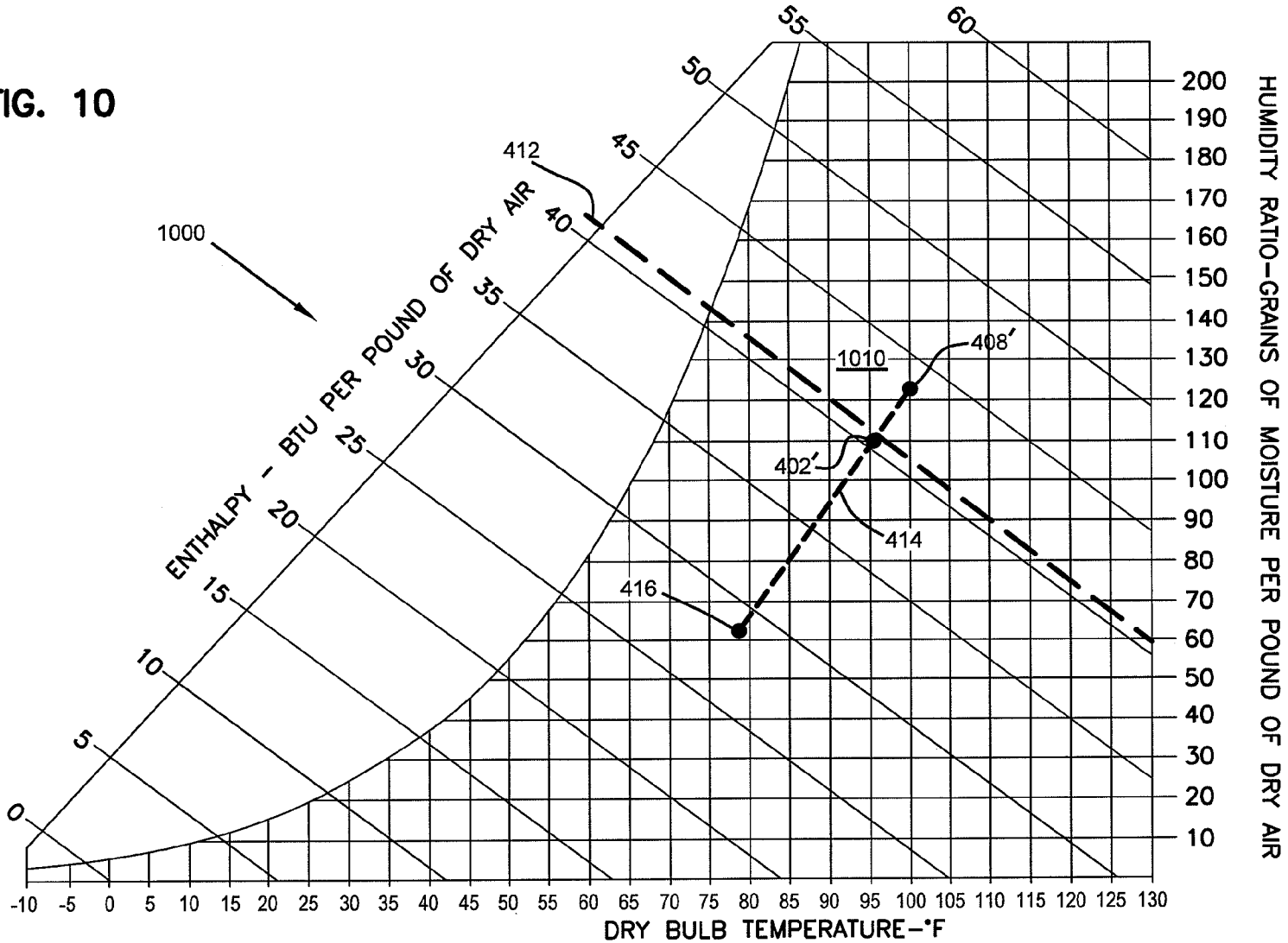
FIG. 10 is a psychrometric chart showing a mixing process step usable with the exemplary process of FIG. 8.
Figure 17:
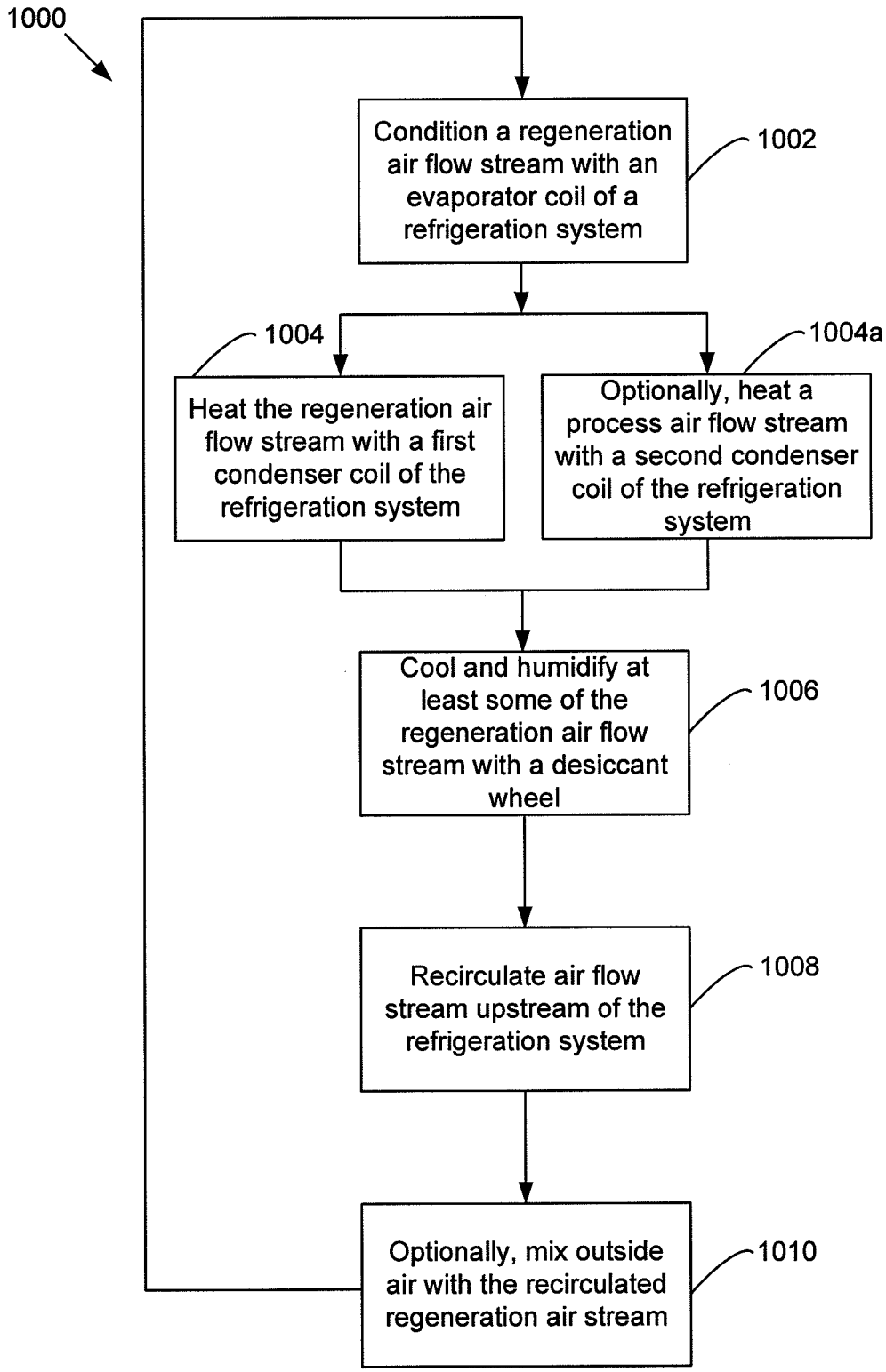
FIG. 17 is a schematic process flow diagram showing the process of FIG. 15 additionally showing the mixing process step shown in FIG. 10 and the hot gas reheat process step shown in FIG. 12.

A first approach to reduce the load on the refrigeration system 232 is to perform a mixing step 1010 wherein outside air is mixed with the recirculated air upstream of the evaporator coil 234. This step is shown in FIGS. 10 and 17. The system 10 can be referred to as being in a mixing mode of operation when step 1010 is implemented, as compared to the full recirculation mode. For the mixing step 1010, an ambient air condition 416 is selected at about 78 degrees F. at about 62 grains of moisture. However, any reasonable conditions for ambient air condition 416 that is below line 412 could be utilized in the process. A mixing line 414 is shown extending between the ambient air condition and the fourth condition 408'. When ambient air and air at the fourth condition 408' are mixed together at a given ratio, the resulting mixed air condition will reside somewhere along this line between the two conditions. As such, it is possible to mix the two air streams such that the mixed air condition brings the air back to a condition below the line 412 that will allow the refrigeration system 232 to operate within the operating envelope 302. As can be seen in FIG. 10, this condition can be found at point condition 402'.

Figure 11:
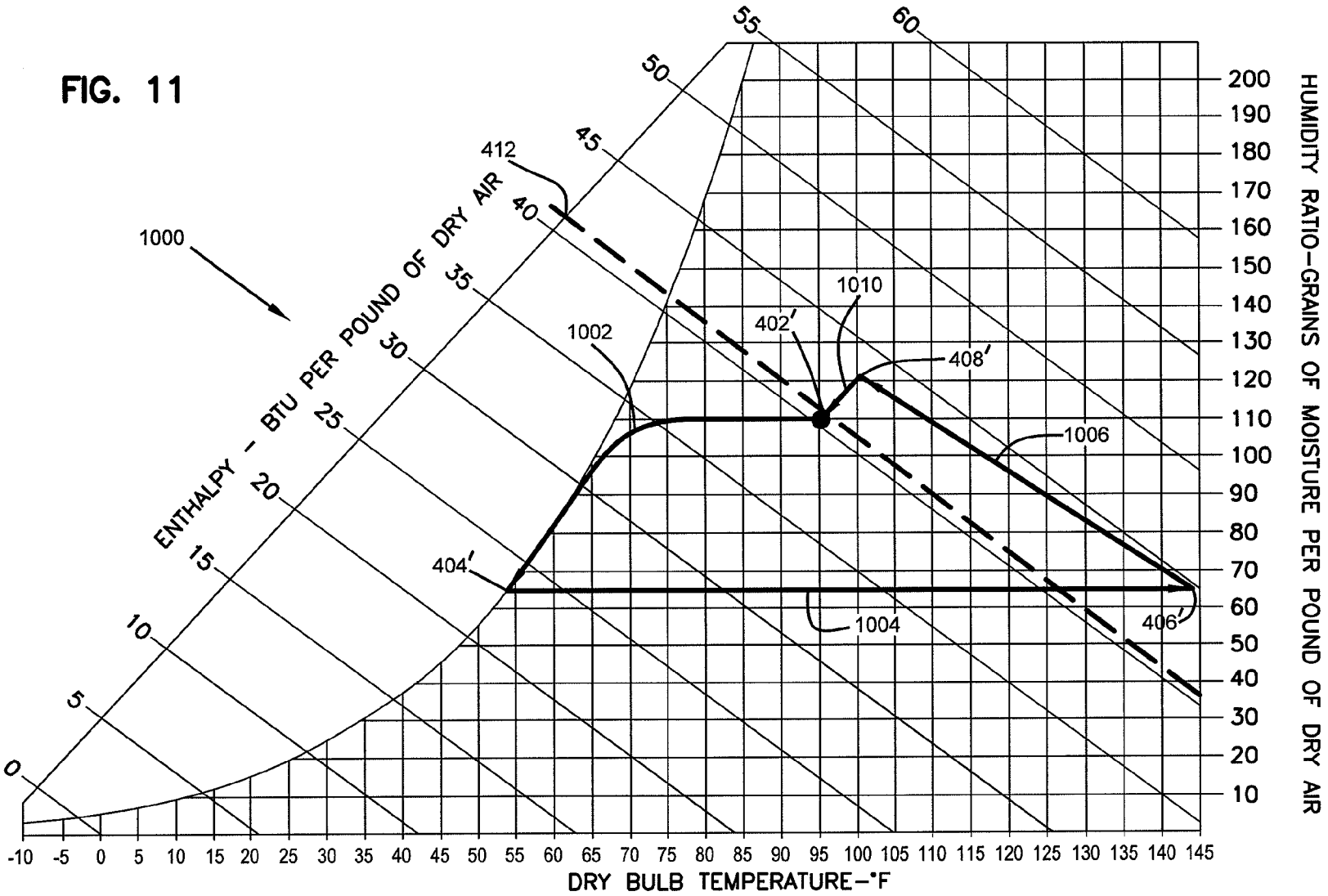
FIG. 11 is a psychrometric chart showing the mixing process step of FIG. 10 applied at the process state shown in FIG. 9.

Referring to FIG. 11, it can now be seen that process 1000 can be operated in a closed loop, continuous condition whereby the mixing step 1010 returns the air from condition 408' to condition 402'. Where only enough air is mixed in step 1010 to bring the mixed air condition just down to the maximum capacity line 412, the system 10 will be operated at maximum dehumidification capacity, as is the case in the example shown at FIG. 9. However, process 1000 may also be operated in the mixed air mode to achieve steady state operation at less than the maximum capacity of the refrigeration system 232, whether or not the fourth condition 408/408' would eventually exceed the condition along line 412.

Figure 12:
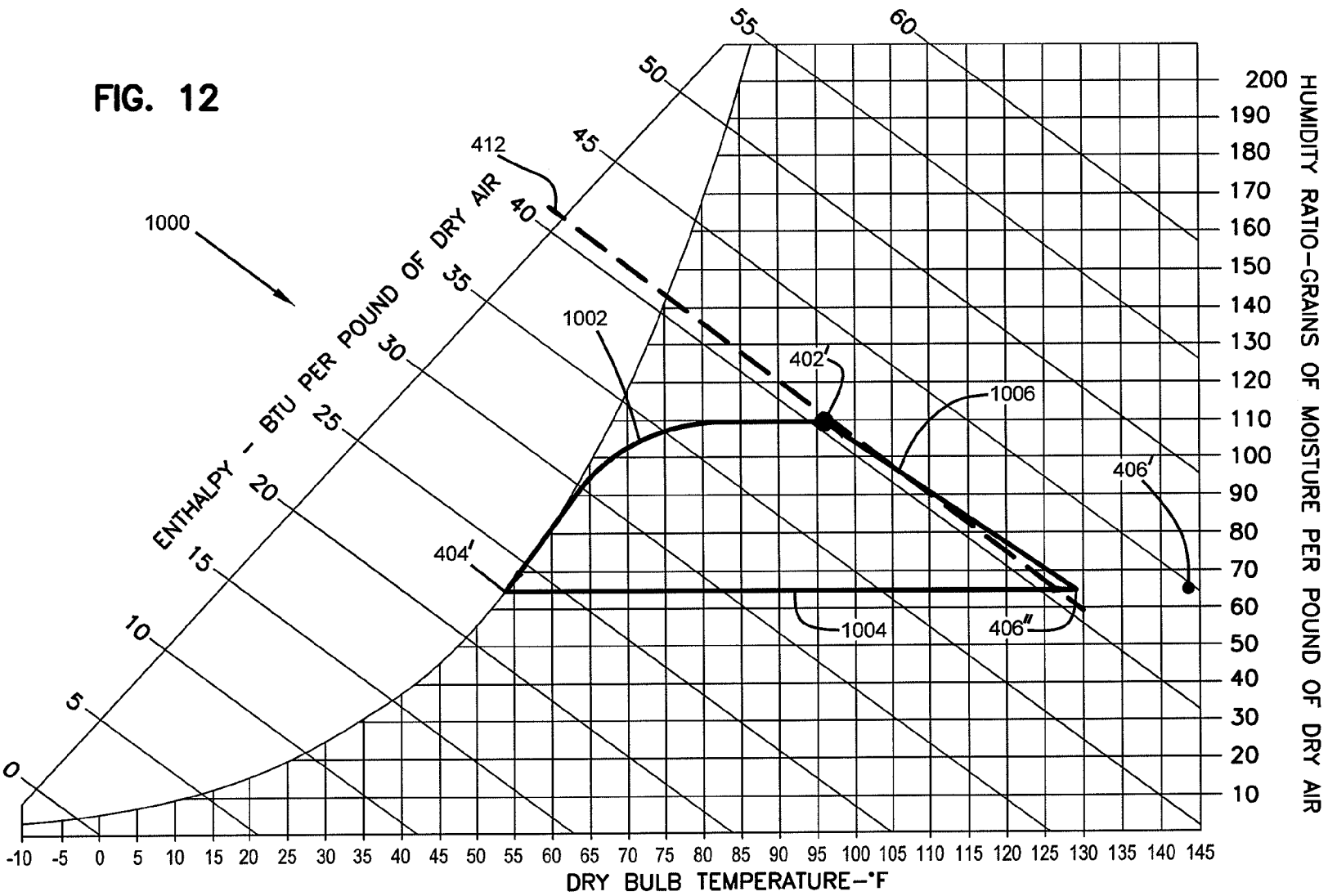
FIG. 12 is a psychrometric chart showing a hot gas reheat process step usable with the exemplary process of FIG. 8.

A second approach to reduce the load on the refrigeration system 232 is to incorporate the heating coil 138 into the refrigeration system 232, as shown in FIG. 6. Where the system 10 is so configured, a step 1004*a* (shown in FIG. 17) may be implemented in conjunction with step 1004 in which the process air flow stream is heated with a second condenser coil, such as coil 138. Such an operation is shown at FIGS. 12 and 17. When part of the condensing load is diverted to coil 138, the total rise in temperature caused by condenser coil 236 during step 1004 is necessarily reduced. As shown, this reduced temperature rise results in a condition 406". As can be seen, condition 406" is shifted to the left of condition 406'. By adjusting the amount of refrigerant that is diverted to coil 138, the refrigeration system 232 can be selectively operated to obtain a desired condition 406" that is anywhere between conditions 404' and 406'. As can be seen at FIG. 12, the condition 406" is selected such that the ending condition 402' from step 1006 is at the maximum cooling capacity line 412 of the refrigeration system 232. However, it should also be understood that the refrigeration system 232 can be operated such that condition 406" is selected to match a dehumidification load of the process air flow stream. Under either mode of operation, it can be readily seen from FIG. 12, that a continuous, steady state operation of process 1000 may be achieved by selectively moving the load from the condenser coil 236 in the regeneration air flow path 200 to the heating coil 138 in the process air flow path 100.

Figure 13:
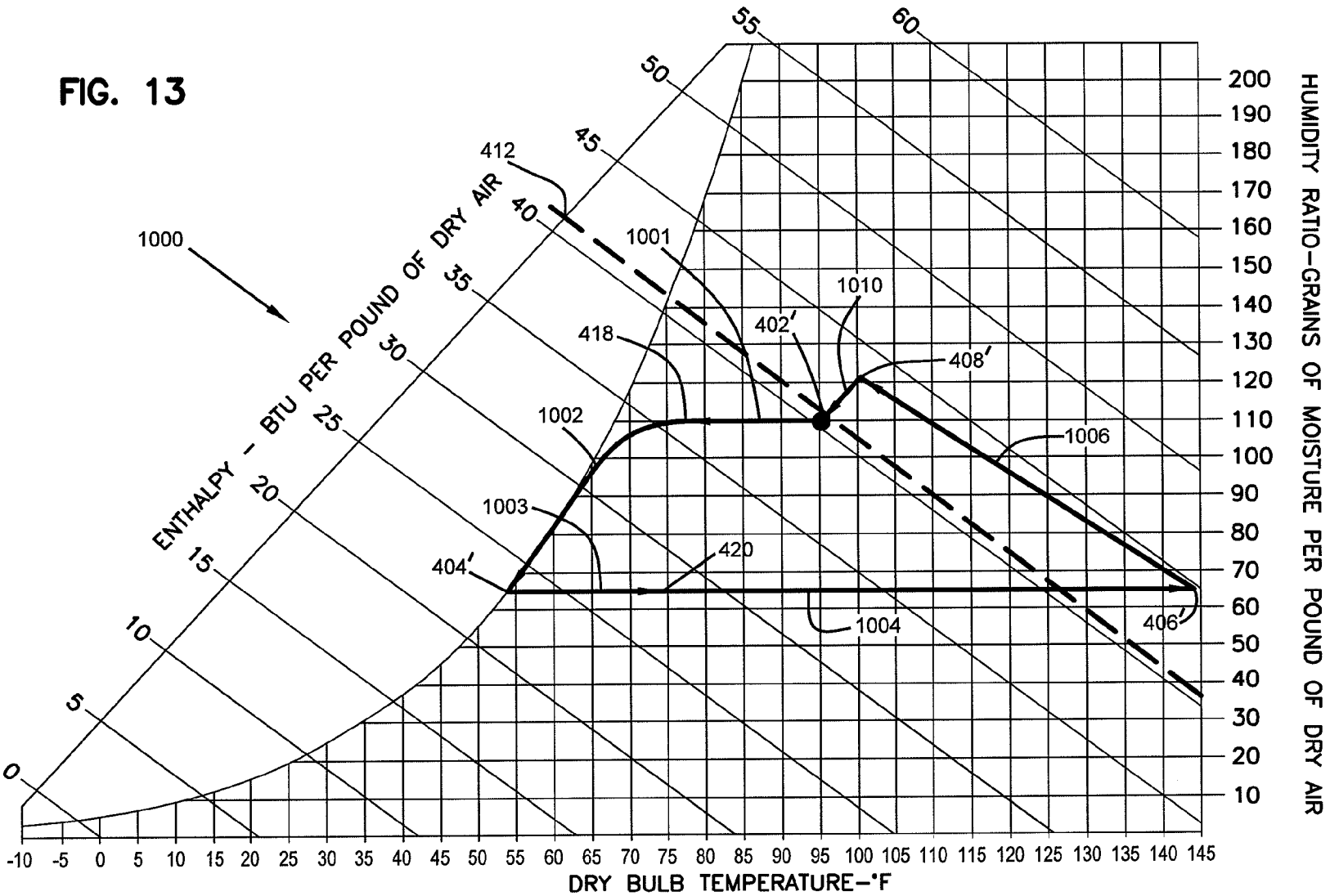
FIG. 13 is a psychrometric chart showing the process shown in FIG. 9 with the use of additional heat exchanger process steps and in conjunction with the mixing process step shown in FIG. 10.
Figure 14:
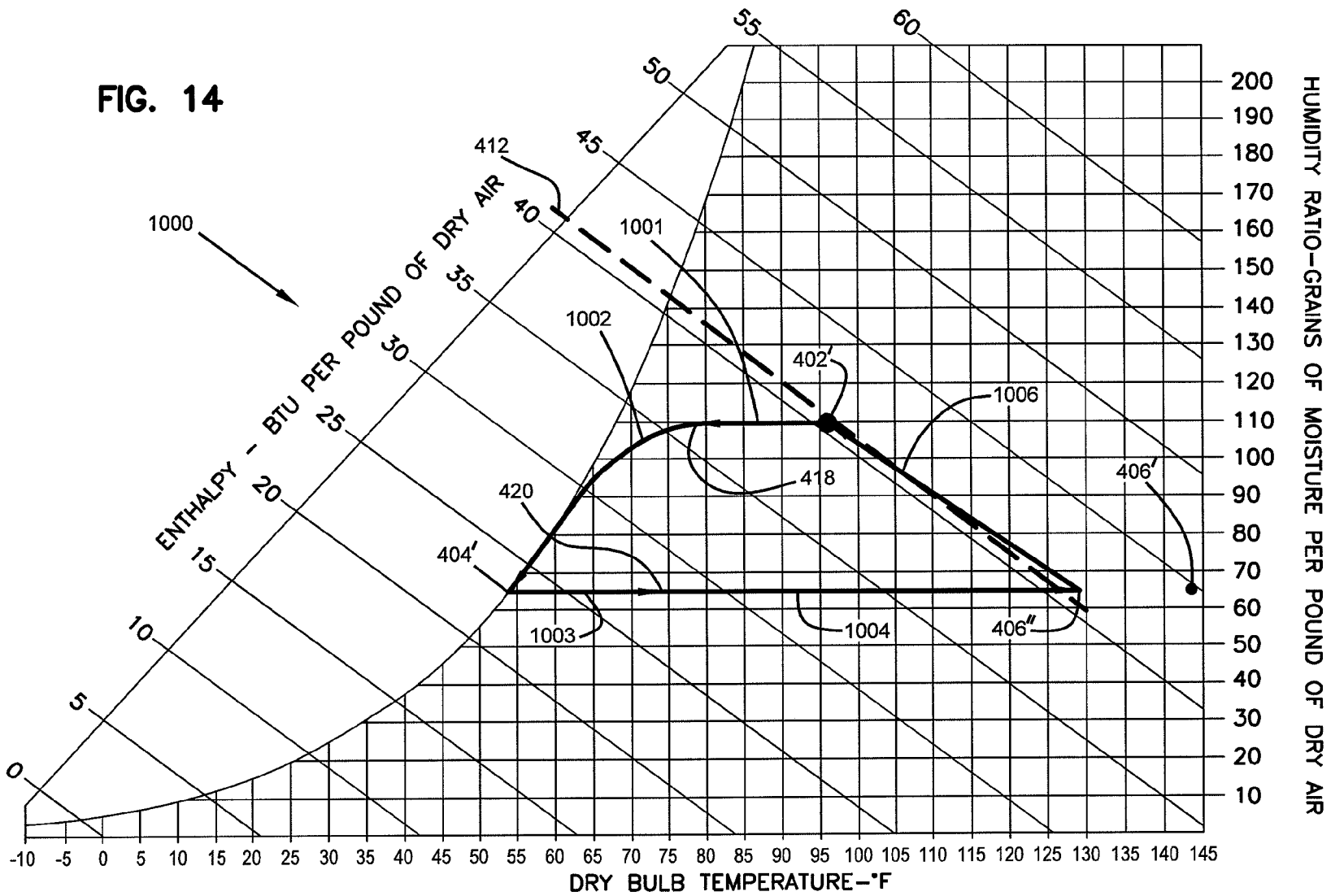
FIG. 14 is a psychrometric chart showing the process shown in FIG. 9 with the use of additional heat exchanger process steps and in conjunction with the hot gas reheat process step shown in FIG. 12.
Figure 18:
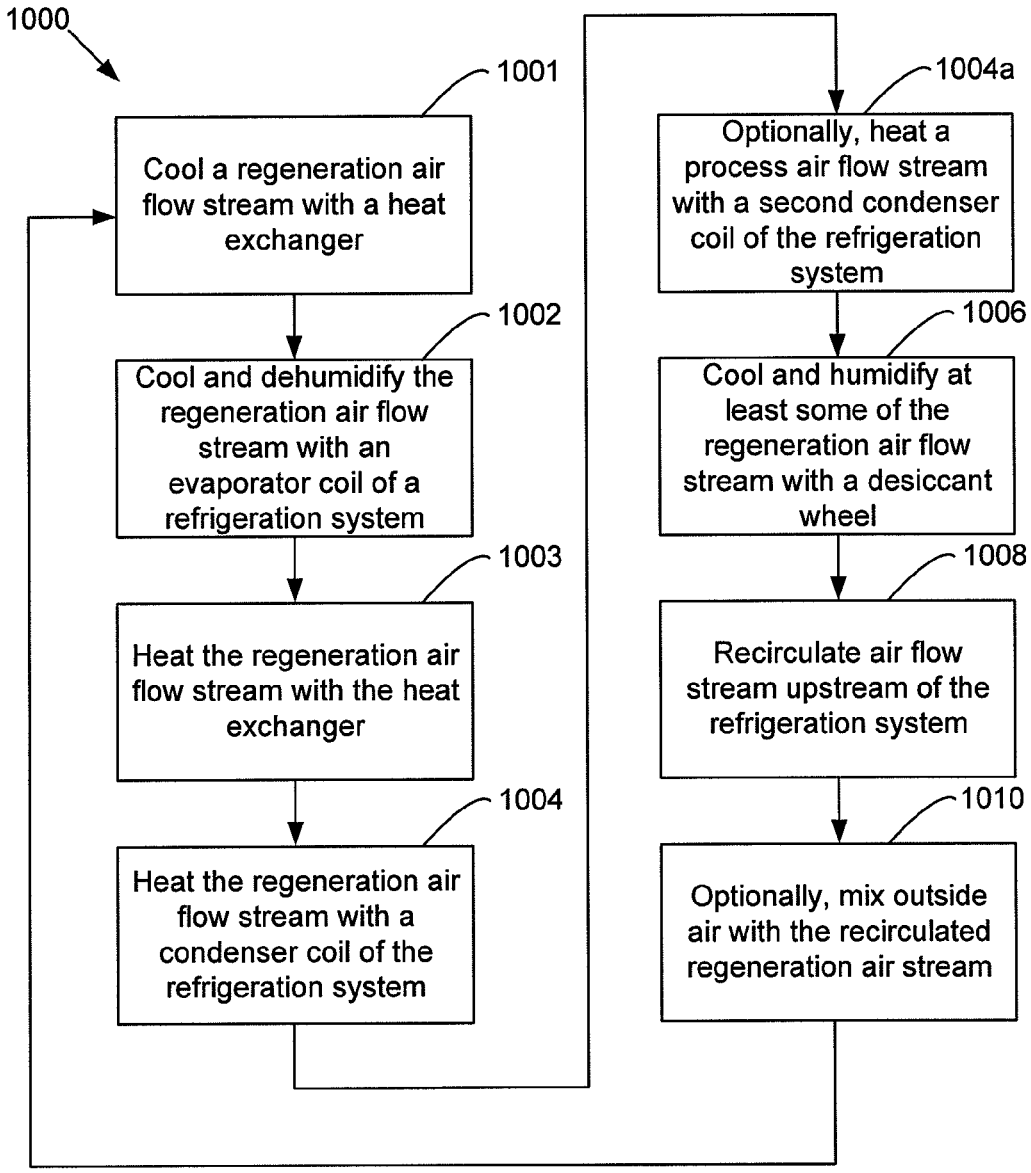
FIG. 18 is a schematic process flow diagram showing the process of FIG. 17 additionally showing the heat exchanger process steps shown in FIGS. 13 and 14.

Referring to FIGS. 13-14 and 18, the process 1000 is further shown incorporating heat exchanger 500. Figure shows the process 1000 using the heat exchanger 500 in conjunction with mixing step 1010 while FIG. 14 shows the process 100 using the heat exchanger 500 in conjunction with the heating step 1004*a*. FIG. 18 shows a flow chart incorporating both options. As shown, an additional process step 1001 is implemented in which the regeneration air is cooled with the heat exchanger 500 to a leaving condition 418. After the regeneration air is cooled and dehumidified in step 1002, the regeneration air is then heated in a step 1003 by the heat exchanger 500 to a leaving condition 420. In the particular embodiment shown, condition 418 is about 74.3 degrees F. and about 61.8 grains moisture while condition 420 is about 76.6 degrees F. and about 108.5 grains moisture.

Also, in some applications, it is desirable for the refrigeration system 232 to reach the maximum capacity line 412, as soon as possible such the system reaches maximum dehumidification capacity as quickly as possible. Even when maximum capacity is not necessary, it is still desirable to increase the regeneration air temperature as quickly as possible such that dehumidification can begin as soon as possible. As such, a warm-up process step 1050 may be incorporated into process 1000, as described below.

Figure 16:
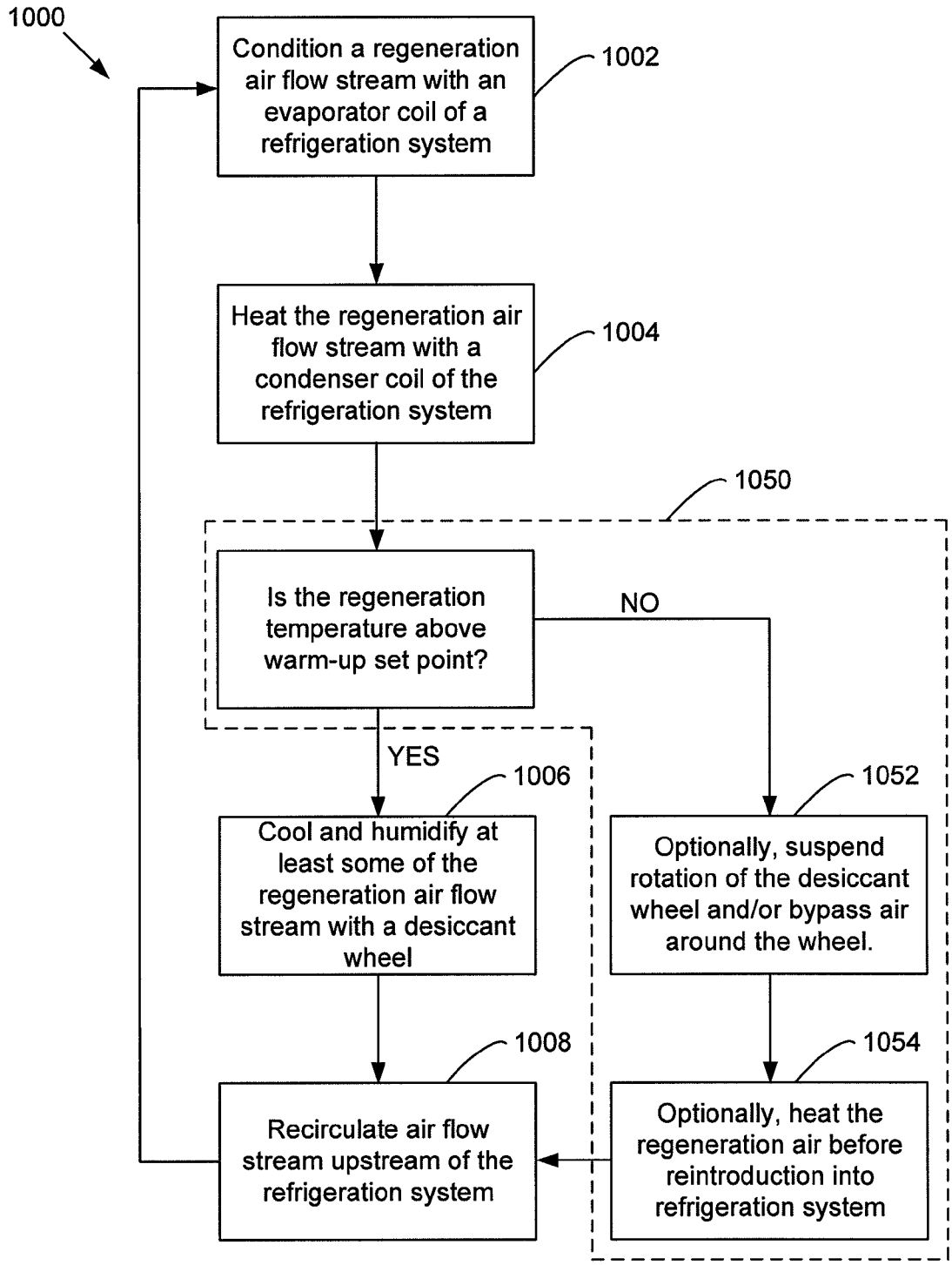
FIG. 16 is a schematic process flow diagram showing the process of FIG. 15 incorporating an additional warm-up process step.

Referring to FIG. 16, warm-up process step 1050 can include a number of measures to accelerate the temperature rise of the regeneration air flow stream. For example, step 1052 shows the rotation of the wheel 114 being suspended until a desired regeneration condition, such as a regeneration air temperature set point is obtained. Optionally, some or all of the regeneration air may also be bypassed around the portion of the desiccant wheel 114 in the regeneration air flow path 200 until the desired regeneration air temperature set point is obtained. Either of these approaches in step 1052 will reduce or eliminate the cooling effect of the wheel 114 on the regeneration air flow stream. Another suitable approach is shown as step 1054 which may be performed with or without step 1052 being performed. Step 1054 includes operating the coil 254 to actively heat the regeneration air flow stream until a regeneration air temperature set point is achieved. This step allows for the wheel 114 to operate at full capacity such that dehumidification can begin immediately, where desired.

The various embodiments described above are provided by way of illustration only and should not be construed to limit the claims attached hereto. Many modes of operation are also possible for the disclosed dehumidification system, and the modes of operation explicitly identified for the system are non-limiting examples. Those skilled in the art will readily recognize various modifications and changes that may be made without following the example embodiments and applications illustrated and described herein, and without departing from the true spirit and scope of the disclosure.

What is claimed is:

1. A dehumidification system comprising:

(a) a regeneration air flow path within which a regeneration air fan and a refrigeration system having an evaporator coil and a condenser coil are disposed, the evaporator and condenser coils sharing a common refrigerant, the regeneration air flow path having a regeneration air inlet and a regeneration air outlet, the evaporator coil and the condenser coil each being located in the regeneration air flow path, the evaporator coil being configured to cool air within the regeneration air flow path and being located between the regeneration air inlet and the condenser coil, the condenser coil being configured to heat air within the regeneration air flow path;

(b) a process air flow path having a process air inlet and a process air outlet within which a process air fan is disposed, the process air flow path being separate from the regeneration air flow path;

(c) a desiccant wheel partially disposed within the process air flow path between the process air inlet and the process air outlet, and partially disposed in the regeneration air flow path between the condenser coil of the refrigeration system and the regeneration air outlet;

(d) a recirculation air flow path having a recirculation air inlet and a recirculation air outlet and being in fluid communication with the regeneration air flow path, the recirculation air inlet being located between the regeneration air fan and the regeneration air outlet, the recirculation air outlet being located between the regeneration air inlet and the evaporator coil of the refrigeration system, the recirculation air flow path being arranged to allow for an air flow to be recirculated through the refrigeration system and the desiccant wheel by the regeneration air fan; and (e) an air-to-air heat exchanger located entirely within the recirculation airflow path and having a first exchanger inlet, a first exchanger outlet, a second exchanger inlet, and a second exchanger outlet, the first exchanger inlet being connected to the regeneration fan, the first exchanger outlet being connected to an inlet side of the evaporator coil, the second exchanger inlet being connected to an outlet side of the evaporator coil, the second exchanger outlet being connected to the condenser.

2. The dehumidification system of claim 1, wherein the refrigeration system further comprises a compressor.

3. The dehumidification system of claim 2, wherein the compressor is a variable output compressor.

4. The dehumidification system of claim 1, further comprising a control system for controlling the refrigeration system and the regeneration fan.

5. The dehumidification system of claim 4, wherein the control system is a direct digital control system.

6. The dehumidification system of claim 1, further comprising a heating coil in the recirculation air flow path.

7. A method for dehumidifying air in a process air flow path with air in a regeneration air flow path, the method comprising:

(a) directing a regeneration air flow stream through a first side of an air-to-air heat exchanger to sensibly cool the regeneration air flow stream;

(b) directing the regeneration air flow stream from the air-to-air heat exchanger first side through an evaporator coil of a refrigeration system;

(c) directing the regeneration air flow stream from the evaporator coil through a second side of the air-to-air heat exchanger to sensibly heat the regeneration air flow stream with regeneration air passing through the first side of the air-to-air heat exchanger;

(d) directing the regeneration air flow stream from the second side of the air-to-air heat exchanger through a condenser coil of the refrigeration system to sensibly heat the regeneration airflow stream, wherein the evaporator coil and condenser coil share a common refrigerant;

(e) directing the regeneration air flow stream from the condenser coil through a first side of a desiccant wheel to cool and humidify the regeneration air flow stream, wherein a second side of the desiccant wheel is in fluid communication with a the process air flow path to dehumidify the air in the process air flow path; and (f) directing the regeneration air flow stream from the desiccant wheel back to the first side of the air-to-air heat exchanger with a regeneration fan.

8. The method of claim 7, further including the step of heating the process air flow path with a second condenser coil of the refrigeration system.

9. The method of claim 8, wherein the step of heating the process air flow path includes modulating a three-way control valve in the refrigeration system, the three-way valve being in communication with the first and second condenser coils of the refrigeration system.

10. The method of claim 9, wherein the three-way control valve is modulated to allow for a compressor of the refrigeration system to operate within an operating envelope.

11. The method of claim 10, wherein the three-way control valve is modulated to match a dehumidification load of the process air flow stream.

12. The method of claim 7, wherein the refrigeration system includes at least one variable output compressor.

13. The method of claim 7, further comprising a warm-up process step comprising the step of suspending the rotation of the wheel until a regeneration air temperature set point has been reached.

14. The method of claim 7, wherein the air-to-air heat exchanger is a fixed plate heat exchanger.

15. A dehumidification system comprising:

(a) a recirculating regeneration airflow path including:

i. a regeneration air fan;

ii. an air-to-air heat exchanger having a first exchanger inlet extending to a first exchanger outlet and having a second exchanger inlet extending to a second exchanger outlet, wherein air flowing between the first exchanger inlet and outlet exchanges sensible heat with air flowing between the second exchanger inlet and outlet, the first exchanger inlet being connected to the regeneration fan;

iii. an evaporator cooling coil of a refrigeration system, the evaporator coil being connected to the first exchanger outlet;

iv. a condenser heat rejection coil of the refrigeration system, the condenser heat rejection coil sharing a common refrigerant with the evaporator coil and being connected to the second outlet of the air-to-air heat exchanger;

v. a desiccant wheel heat exchanger having a first side and a second side, the first side being connected to the condenser heat rejection coil at a first side inlet and connected to the regeneration fan at a first side outlet; and (b) a process airflow path including:

i. a process air inlet connected to a second side inlet of the desiccant wheel second side;

ii. a process air fan connected to a second side outlet of the desiccant wheel second side.

16. The dehumidification system of claim 15, wherein the process airflow path further includes a process air heating coil and a process air cooling coil.

17. The dehumidification system of claim 16, wherein the process air heating and cooling coils are located downstream of the desiccant wheel second side.

18. The dehumidification system of claim 15, wherein the air-to-air heat exchanger is a fixed plate heat exchanger.

* * * * *